US006280152B1

(12) United States Patent
Sugiura et al.

(10) Patent No.: US 6,280,152 B1
(45) Date of Patent: Aug. 28, 2001

(54) VARIABLE-TYPE SWASH PLATE COMPRESSOR HAVING A COCK MEMBER FOR FIXED CAPACITY OPERATION AND MANUFACTURING METHOD THEREFOR

(75) Inventors: Manabu Sugiura; Takahiro Hoshida, both of Aichi-ken (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/290,499

(22) Filed: Apr. 12, 1999

(30) Foreign Application Priority Data

Apr. 14, 1998 (JP) ..... 10-102479

(51) Int. Cl.[7] ..... F04B 1/12

(52) U.S. Cl. ..... 417/269; 417/238; 417/222.2; 92/59

(58) Field of Search ..... 417/222.2, 269, 417/238; 92/12.2, 59, 71

(56) References Cited

U.S. PATENT DOCUMENTS

Re. 32,403 * 4/1987 Bobier ..... 92/12.2
4,815,358 * 3/1989 Smith ..... 92/12.2
5,387,091 * 2/1995 Kawaguchi et al. ..... 92/12.2
5,797,730 * 8/1998 Kawaguchi et al. ..... 417/222.2

FOREIGN PATENT DOCUMENTS 0 301 519 A2 2/1989 (EP) .
64-32078 2/1989 (JP) .
6-336978 12/1994 (JP) .
9-228948 9/1997 (JP) .
9-268974 10/1997 (JP) ..... 417/222.2
9-287563 11/1997 (JP) .

* cited by examiner

*Primary Examiner*—Timothy S. Thorpe
*Assistant Examiner*—Cheryl J. Tyler
(74) *Attorney, Agent, or Firm*—Morgan & Finnegan, L.L.P.

(57) ABSTRACT

A fixed capacity swash plate type compressor permits cost reduction by using components and assembly steps common to those of a variable capacity swash plate type compressor. In place of a capacity control valve assembly that controls the opening of at least one of a refrigerant gas supplying passage and a bleed passage to adjust a crank chamber pressure, a cock member that maintains communication between a crank chamber area and a suction pressure area to disable capacity control while the compressor is in operation is installed in a compartment of the capacity control valve assembly in the variable capacity swash plate type compressor.

8 Claims, 16 Drawing Sheets

VARIABLE-TYPE SWASH PLATE COMPRESSOR HAVING A COCK MEMBER FOR FIXED CAPACITY OPERATION AND MANUFACTURING METHOD THEREFOR

BACKGROUND OF THE INVENTION

1. Field of the Invention

The present invention relates to a fixed capacity swash plate type compressor that has a fixed refrigerant discharge capacity, and a manufacturing method for the same.

2. Description of the Related Art

There are two types of conventional swash plate type compressors used with automotive air conditioners. In one type, the tilt angle or inclination of the swash plate with respect to a drive shaft is fixed so as to fix the discharge capacity of a refrigerant. The other is a variable capacity type in which the inclination of the swash plate with respect to the drive shaft is changed to so that the discharge capacity of the refrigerant may be changed.

The foregoing conventional fixed capacity swash plate type compressor has a simpler structure than the variable capacity swash plate type compressor, thus having the advantage of a lower cost. The fixed capacity type, however, has a problem in that it has great pressure fluctuations at startup i.e., a large startup shock because the pistons therein always operate at full stroke. The fixed capacity type also has a problem in that frequent switching ON/OFF of an electromagnetic clutch causes shock because the refrigerating capacity is adjusted by turning the electromagnetic clutch ON/OFF.

On the other hand, variable capacity swash plate type compressors are operated with the swash plate thereof set at a minimum inclination at startup, so that startup shocks such as those taking place in the fixed capacity swash plate type compressor are suppressed. Further, the variable capacity type does not require that the electromagnetic clutch be turned ON/OFF frequently because the inclination of the swash plate is adjusted in accordance with refrigeration load to control the capacity; therefore, it provides higher operating efficiency and is superior in terms of comfort. The variable capacity type, however, incorporates a hinge mechanism for changing the inclination of the swash plate according to crank chamber pressure and is constructed so as to control the crank chamber pressure arising from changes in a suction pressure with a capacity control valve assembly installed in the housing assembly. This has a drawback in that the structure becomes more complicated with more components and the use of the expensive capacity control valve assembly leads to higher cost.

Thus, both types of swash plate compressors have their advantages and disadvantages, so that they need to be chosen properly according to individual applications. However, there are a considerable number of components that have not been standardized even for compressors having the same capacity because of the structural difference in which the inclination of the swash plate is either fixed or made variable. This has been adversely affecting efforts for achieving economies of mass production and has been responsible for increased cost.

As a solution to the problem discussed above, there has been disclosed, in Japanese Patent Application Laid-open No. 9-228948, a fixed capacity swash plate type compressor intended for standardized components. This conventional known fixed capacity swash plate type compressor is fabricated by replacing a rear housing provided with a capacity control valve assembly in a variable capacity swash plate type compressor with a rear housing that is not provided with the capacity control valve assembly. Hence, the standardization of components between these two compressors is not yet very satisfactory. In addition, the structural modification requires that the assembly procedure or assembly process of the variable capacity swash plate type compressor be significantly changed. Thus, further improvements in productivity has been demanded.

SUMMARY OF THE INVENTION

Accordingly, the present invention has been made with a view toward solving the problems described above, and it is an object thereof to provide a fixed capacity swash plate type compressor adapted to use the same components and assembly process as those of a variable capacity swash plate type compressor to thereby lower the cost thereof.

To this end, according to one aspect of the present invention, in a variable capacity swash plate type compressor, a capacity control valve assembly, which controls the opening of at least either the communication between a crank chamber area and a discharge pressure area or the communication between a crank chamber area and a suction pressure area to adjust a crank chamber pressure, is replaced by a cock member that maintains continuous communication between a crank chamber area and a suction pressure area, to disable capacity control while the compressor is in operation, the cock member being placed in a housing of the capacity control valve assembly.

According to the present invention configured as described above, a variable capacity swash plate type compressor can be modified into a fixed capacity swash plate type compressor simply by replacing the capacity control valve assembly having a complicated structure with the cock member, while leaving the rest of the structure of the compressor unchanged. Hence, inexpensive components can be used, and commonality of the components and manufacturing processes can be achieved to improve productivity, thus permitting a further reduction in cost.

In addition, the swash plate is adapted to allow a change of the inclination similar to that of the variable capacity swash plate type compressor. Therefore, when the compressor that has been in a balanced state in pressure during a halt is started up, the swash plate is at a minimum inclination; hence, startup shock will be suppressed, contributing to extended service life of internal components.

In a preferred form of the present invention, in a case wherein the capacity control valve assembly in the variable capacity swash plate type compressor controls the opening and closing of the communication between the crank chamber area and the suction pressure area, the capacity control valve assembly is replaced by a cock member that is adapted to maintain the communication between the crank chamber area and the suction pressure area continuously. The cock member is arranged in a bleed passage between the crank chamber and the suction pressure area and is adapted to maintain the continuous communication between the crank chamber area and the suction pressure area in the compartment.

In another preferred form of the present invention, in a case wherein the capacity control valve assembly in the variable capacity swash plate type compressor controls the opening and closing of the communication between the discharge pressure area and the crank chamber area, the capacity control valve assembly is replaced by a cock member that is adapted to always cut off the communication between the discharge pressure area and the crank chamber area at all times, the cock member being placed in the housing.

In yet another preferred form of the present invention, in the immediately preceding preferred form, the cock member is provided with a passage allowing communication between the discharge pressure area and an atmospheric pressure area, and a relief valve mechanism is installed in the passage for releasing refrigerant gas in the discharge pressure area to the atmosphere if a discharge pressure exceeds a predetermined value.

With this arrangement, since the relief valve mechanism is provided in the cock member, there is no need to employ a relief valve separately. Hence, it is possible to further reduce the cost.

In a further preferred form in accordance with the present invention, in a case wherein the capacity control valve assembly in the variable capacity swash plate type compressor controls the opening and closing of the communication between the discharge pressure area and the crank chamber area and the communication between the crank chamber area and the suction pressure area, respectively, the capacity control valve assembly is replaced by a cock member that is adapted to always cut off the communication between the discharge area and the crank chamber area and to maintain the continuous communication between the crank chamber area and the suction pressure area, the cock member being placed in the housing assembly so as to construct the bleed passage via the cock member.

In still a further preferred form of the present invention, the housing assembly is communicated with an oil reservoir for storing a lubricant separated from discharged gas, and the cock member is provided with an oil return passage that allows communication between the oil reservoir and a crank chamber.

With this arrangement, since the oil return passage is provided in the cock member, there is no need to provide an oil return passage separately. This enables a further cost reduction.

In still another preferred form of the present invention, the capacity control valve assembly is an electromagnetic capacity control valve assembly provided with an electromagnetic coil that can be externally controlled, and the compartment is arranged in the refrigerant gas supplying passage, an electromagnetic cock member provided with an electromagnetic coil in place of the electromagnetic capacity control valve assembly, and the refrigerant gas supplying passage is closed as the electromagnetic coil is energized when the compressor is operated, while the refrigerant gas supplying passage is opened as the electromagnetic coil is deenergized when the compressor is stopped.

With this arrangement, the communication between the crank chamber and the suction pressure area is maintained by the electromagnetic cock member during normal operation and a crank chamber pressure is maintained at a suction chamber pressure; hence, the compressor functions as a fixed capacity swash plate type. When the compressor is stopped, the communication between the crank chamber area and the suction pressure area by the electromagnetic cock member is cut-off. This causes the crank chamber pressure to quickly increase and the swash plate is maintained at a minimum inclination, thus positively avoiding startup shock of the compressor.

In still another preferred form of the present invention, there is provided a manufacturing method comprising the steps of forming a compartment in the housing assembly so as to be able to selectively accommodate either a capacity control valve assembly that controls the opening of at least one of the communication between the crank chamber area and the discharge pressure area and the communication between the crank chamber area and the suction pressure area so as to adjust a crank chamber pressure or a cock member which can maintain continuous communication between the crank chamber area and the suction pressure area to disable capacity control while the compressor is in operation, and installing the cock assembly in the compartment in place of a capacity control valve assembly.

DESCRIPTION OF THE PREFERRED EMBODIMENT

Figure 1:
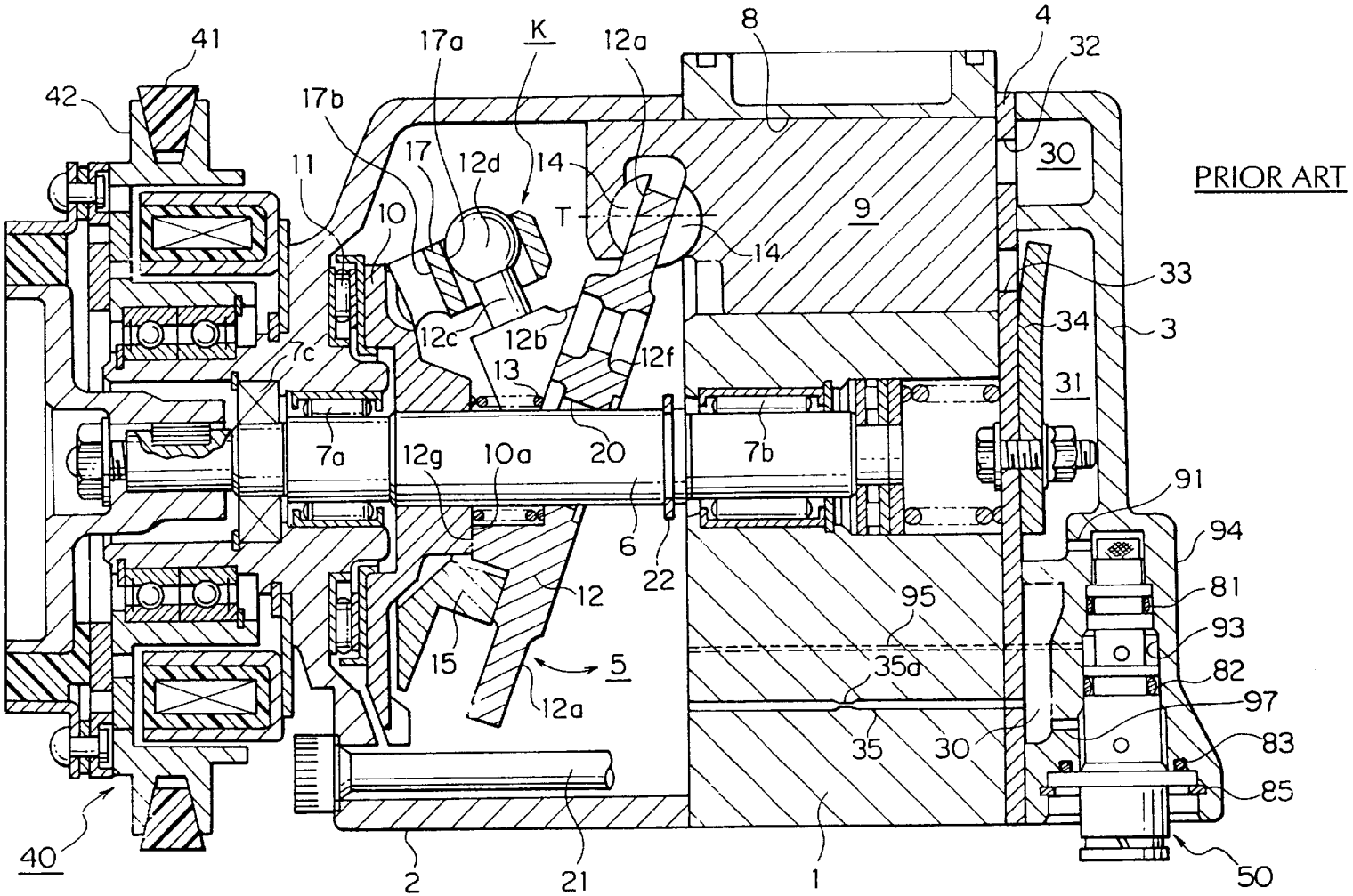
FIG. 1 is a longitudinal sectional view showing a conventional variable capacity swash plate type compressor of a first embodiment.

Embodiments of the present invention will now be described in conjunction with the accompanying drawings. In the drawings and description of the respective embodiments, common parts or constituents are assigned like reference numerals, and the descriptions thereof are simplified or omitted.

First referring to FIG. 1 to FIG. 7, a fixed capacity swash plate type compressor in accordance with a first embodiment will be described.

FIGS. 1 to 4 illustrate the structure of a variable capacity swash plate type compressor that will be modified into the fixed capacity swash plate type compressor of the first embodiment. In the variable capacity swash plate type compressor, a front housing 2 is joined to the front end of a cylinder block 1, while a rear housing 3 is joined to the rear end of the cylinder block 1 via a valve plate 4, these housings being coupled with a bolt 21 to construct the housing assembly as shown in FIG. 1. A drive shaft 6 that extends in the axial direction is placed in a crank chamber 5 formed by the cylinder block 1 and the front housing 2. The drive shaft 6 is rotatably supported by a shaft sealing device 7*c* and bearings 7*a* and 7*b*, a front end portion of the shaft being provided with an electromagnetic clutch 40. The electromagnetic clutch 40 is engaged and disengaged, and the rotating movement (drive power) of the engine is transmitted to the drive shaft 6 via a belt 41 and a pulley 42 when the clutch 40 is engaged.

The cylinder block 1 is provided with a plurality of cylinder bores 8 around the drive shaft 6, and a piston 9 is fitted into each of the cylinder bores 8, respectively.

A rotor 10 is mounted integral with the drive shaft 6 in the crank chamber 5 such that it is able to rotate in synchronicity with the drive shaft 6 and is rotatably supported by a thrust bearing 11 disposed between itself and the front housing 2. A pressing spring 13 which pushes the swash plate 12 toward the rear housing 3 is installed between the rotor 10 and a swash plate 12.

The swash plate 12 has smooth sliding surfaces 12*a* on the outer periphery of both sides of the surfaces, semispherical shoes 14 contacting with the sliding surfaces 12*a*. The pistons 9 are installed such that they are able to reciprocate in each of the cylinder bores 8, respectively. Each piston 9 has a spherical supporting surface on an outer end portion thereof that engages with the outer peripheral surfaces of the shoes 14.

Figure 2:
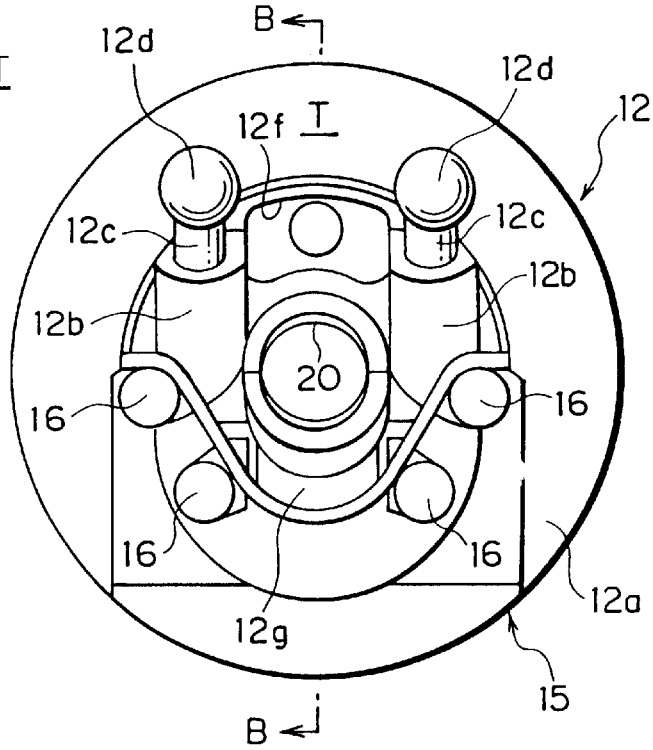
FIG. 2 PRIOR ART
FIG. 2 is a front view showing a swash plate to which a counterweight has been attached in the swash plate type compressor shown in FIG. 1.
Figure 3:
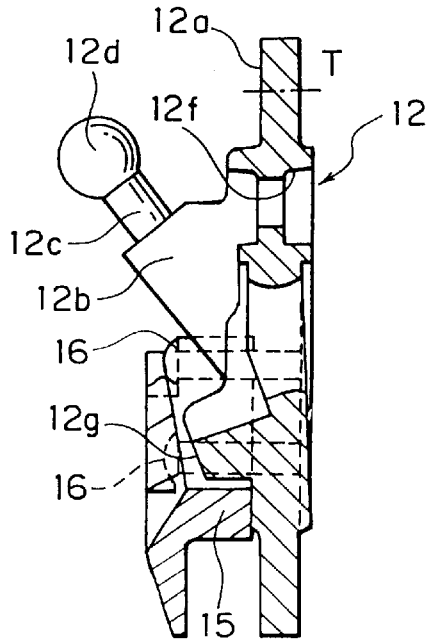
FIG. 3 PRIOR ART
FIG. 3 is a sectional view taken along the line B-B in FIG. 2.

The swash plate 12 is further provided with a pair of brackets 12*b* on the upper dead center side in an area inward from the sliding surface 12*a* of the swash plate 12 on the side closer to the rotor 10 as shown in FIG. 1 to FIG. 3. The brackets 12*b* are located at both sides of the upper dead center position T in the swash plate 12, with the drive shaft 6 therebetween as illustrated in FIG. 2. A guide pin 12*c* has one end thereof secured to each bracket 12*b*, and the other end thereof being provided with a spherical portion 12*d*. The brackets 12*b*, the guide pins 12*c*, and the spherical portions 12*d* construct a coupling portion of a hinge mechanism K in the compressor. A weight reduction portion 12*f* is formed between the two brackets 12*b* as shown in FIG. 2.

In the swash plate 12, a through hole 20, in which the drive shaft 6 is inserted, is provided in a central area thereof; and a counterweight 15, which covers the sliding surface 12*a* while avoiding the shoes 14 on the rotor 10 side, is installed using rivets 16 on a lower dead center side of the inward area on the rotor 10 side.

The inclination of the swash plate 12 is maintained at a maximum angle by a front end surface 12*g* of the through hole 20 abutting against a rear end surface 10*a* on the inner peripheral side of the rotor 10; it is maintained at a minimum angle by the rear surface of the swash plate 12 around the through hole 20 abutting against a circlip 22.

As shown in FIG. 1, a pair of support arms 17 also constituting a part of the hinge mechanism K project toward the rear side at the top of the rotor 10 and upward with respect to the axis of the compressor. The distal end of each of the support arms 17 is provided with a guide hole 17*a* in which the spherical portion 12*d* of the guide pin 12*c* is rotatably and slidably inserted. The directions of the centerlines of the guide holes 17*a* are set so that the upper dead center position T of the pistons 9 will not substantially be shifted forward or backward regardless of a change in the inclination of the swash plate 12.

Formed in the rear housing 3 are a suction chamber 30 and a discharge chamber 31. The suction chamber 30 is in communication with the crank chamber 5 through a bleed passage 35 equipped with a throttle 35*a* midway thereof. The throttle 35*a* serves to add to the flow resistance of a refrigerant running through the bleed passage 35; hence, the restrictor need not be provided if the passage itself has a high refrigerant flow resistance. The suction chamber 30 and the discharge chamber 31 are in communication with a compression chamber formed between the valve plate 4 and the each piston 9 in the cylinder bore 8 via suction port 32 and discharge port 33 formed in the valve plate 4. Each suction port 32 is provided with an suction valve (not shown) that opens or closes the suction port 32 in accordance with the reciprocating movement of the piston 9. Each discharge port 33 is provided with a discharge valve (not shown) that opens or closes the discharge port 33 in accordance with the reciprocating movement of the piston 9 while being restricted by a retainer 34.

A bulge portion 94 for holding a capacity control valve assembly 50 is formed on the rear housing 3. The bulge portion 94 is provided with a compartment 93 for holding the capacity control valve assembly 50, and the capacity control valve assembly 50 is placed in the compartment 93.

Figure 4:
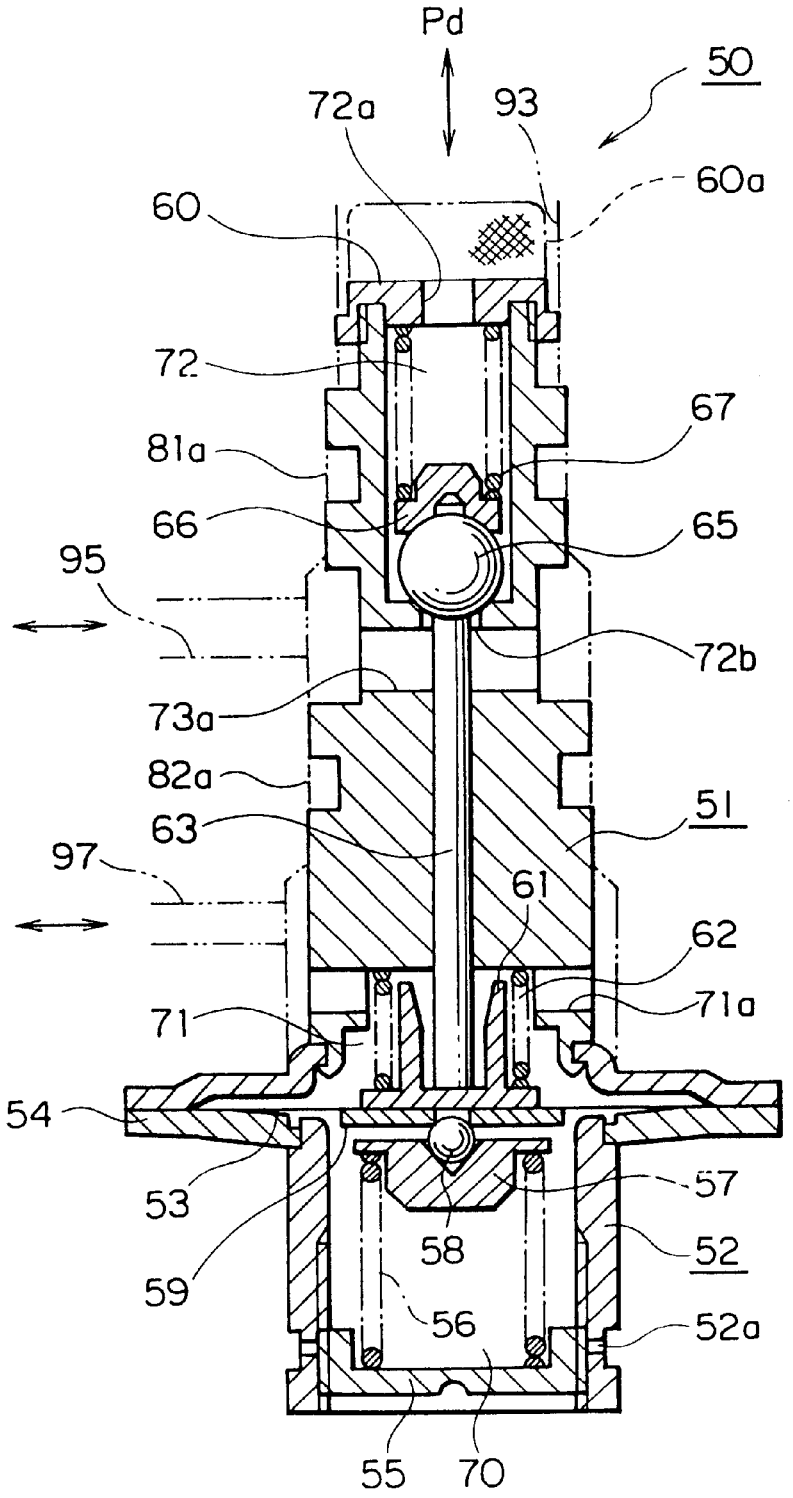
FIG. 4 PRIOR ART
FIG. 4 is an exaggerated longitudinal sectional view showing a capacity control valve assembly installed in the compressor shown in FIG. 1 and FIG. 10.

As shown in FIG. 4 in detail, the capacity control valve assembly 50 is made up of a valve main body 51 and a cylindrical member 52, between which a diaphragm 53 serving as a pressure sensing device is held by a clamping member 54.

A covering plug 55 is screwed to the opening of the cylindrical member 52. The cylindrical member 52, the covering plug 55, the diaphragm 53, and the clamping member 54 make up an atmospheric chamber 70. The atmospheric chamber 70 is in communication with the atmosphere through an air hole 52*a* formed in the side surface of a threaded portion of the cylindrical member 52 and a backlash between the threaded portion and the covering plug 55 at the threaded portion so as to maintain an atmospheric pressure in the atmospheric chamber 70. In the atmospheric chamber 70, a spring 56 that applies a predetermined pressing force is installed between the covering plug 55 and a retaining fixture 57 having a section shaped like a hat. The spring 56 presses the diaphragm 53 via the retaining fixture 57, a ball 58, and a link-shaped retaining fixture 59.

In the valve main body 51, a suction pressure chamber 71 is formed on the diaphragm 53 side, a port 73*a* in communication with a central portion of the compartment 93 is provided at a central portion thereof, and a discharge pressure chamber 72 is formed at the distal end thereof.

The suction pressure chamber 71 is in communication with the suction chamber 30 via a port 71*a*, an inlet of the compartment 93 and a pressure detection passage 97 that allows communication between the inlet of the compartment 93 and the suction chamber 30. Thus, a suction pressure Ps is introduced into the suction pressure chamber 71. Provided in the suction pressure chamber 71 is a retaining fixture 61 which comes in contact with the diaphragm 53 and which is composed of a plane portion and a cylindrical portion. A spring 62 applying a predetermined pressure is installed between the plane portion and the distal side wall surface of the suction pressure chamber 71 such that it surrounds the cylindrical portion of the retaining fixture 61. One end of a rod 63, which is slidably inserted in the valve main body 51, is secured to the retaining fixture 61. A spherical valve member 65 is fixed to the other end of the rod 63.

The distal end opening of the discharge pressure chamber 72 is closed by a cover 60 which has a port 72*a* at a central portion thereof. A valve hole 72*b* is provided in a wall member located between the discharge pressure chamber 72 and a port 73*a* provided at a central portion of the valve main body 51, and the portion around the valve hole 72*b* is provided with a valve seat on which the spherical valve member 65 can be seated. The discharge pressure chamber 72 is further equipped with a retaining fixture 66 that comes in contact with the spherical valve member 65, and a spring 67 applying a predetermined pressing force is installed between the retaining fixture 66 and the cover 60. The discharge pressure chamber 72 is in communication with the discharge chamber 31 via the port 72*a*, the distal end portion of the compartment 93, and a communicating hole 91 provided in the rear housing 3, thus introducing a discharge pressure Pd into the discharge pressure chamber 72. The discharge pressure chamber 72 is also in communication with the crank chamber 5 via the valve hole 72*b*, the port 73*a* at the central portion of the valve main body 51, the central portion of the compartment 93, and a refrigerant gas supplying passage 95, thus introducing a crank chamber pressure Pc into the discharge pressure chamber 72. Reference numeral 60*a* denotes a filtering member on the cover 60.

In the capacity control valve assembly 50 having the configuration described above, O rings 81 and 82 are fitted in O ring grooves 81*a* and 82*a*, respectively. An O ring 83 is attached to a plane of a stepped portion at the inlet side of the compartment 93 as shown in FIG. 1. The capacity control valve assembly 50 is inserted in the compartment 93 so that the cylindrical member 52 of the capacity control valve assembly 50 is positioned on the outer side of the compressor, then a fixing ring 85 is attached to fix the capacity control valve assembly 50 in the compartment 93 of the rear housing 3. Installing the capacity control valve assembly 50 in this manner maintains airtightness between the distal end portion of the compartment 93 in communication with the discharge chamber 31 via the communicating hole 91 and the central portion of the compartment 93 in communication with the crank chamber via the refrigerant gas supplying passage 95, between the middle portion of the compartment 93 and the intake portion of the compartment 93 in communication with the suction chamber 30 via the pressure detection passage 97, and between the suction portion of the compartment 93 and the atmospheric air, respectively.

In the compressor constructed as explained above, high pressure and low pressure are in balance in a refrigerant circuit immediately before the compressor is started, and if the suction pressure Ps is higher than a preset value, a resultant force of the pressure of the suction pressure chamber 71 formed in the capacity control valve assembly 50 and the spring 62 overcomes a resultant force of the atmospheric pressure of the atmospheric chamber 70 and the spring 56 and is applied to the diaphragm 53 causing the diaphragm 53 to be shifted toward the atmospheric chamber 70. Hence, the spherical valve member 65 connected to the rod 63 closes the valve hole 72*b* to cut off the communication between the crank chamber 5 and the discharge chamber 31. The swash plate 12 swings counterclockwise in the figure to retreat while keeping the inner surface of the through hole 20 abutted against the peripheral surface of the drive shaft 6 by the pressing force applied by the spring 13. Thus the swash plate 12 is in a position corresponding to the minimum inclination angle because of the restriction by the circlip 22. At this time, the spherical portion 12*d* of the swash plate 12 slides toward the drive shaft 6 in the guide hole 17*a* of the hinge mechanism K.

Under the foregoing condition, when the drive shaft 6 is rotated via the electromagnetic clutch 40, the swash plate 12 at the minimum inclination angle rotates integrally with the drive shaft 6, and the pistons 9 reciprocate in the cylinder bores 8 via the shoes 14 to start compression work. The communication between the crank chamber 5 and the discharge chamber 31 has been cut off by the capacity control valve assembly 50. Therefore, blowby gas leaked into the crank chamber 5 from the cylinder bores 8 during the compression work is circulated to the suction chamber 30 via the bleed passage 35, and the crank chamber pressure Pc is maintained at a level nearly equal to the suction pressure Ps. After the operation is started, the swash plate 12 is shifted to the maximum inclination angle.

Thus, the spherical portion 12*d* of the swash plate 12 slides away from the drive shaft 6 along the centerline in the guide hole 17*a* of the hinge mechanism K. The swash plate 12 swings clockwise in the figure while keeping the inner surface of the through hole 20 abutted against the peripheral surface of the drive shaft 6 and advances against the spring 13. This causes the inclination angle of the swash plate 12 to gradually increase until it reaches the maximum angle at which the counterweight 15 comes in contact with the rotor 10. Thus, operation is performed with the pistons 9 at their maximum stroke.

In this way, the pistons 9 reach their maximum stroke, that is, the compressor is operated at its full capacity soon after the compressor is started. A refrigerant gas introduced from the suction chamber 30 into the cylinder bores 8 is compressed and discharged into the discharge chamber 31, and the discharged gas goes through a discharge port, not shown, and is sent out to an external refrigerant circuit.

Continuing the full-capacity operation gradually lowers the vehicular compartment temperature. When the suction pressure Ps, which follows the decrease of the vehicular compartment temperature, falls below a preset value, the resultant force of the pressure in the suction pressure chamber 71 conducted via the pressure detection passage 97 and a port 71*a* and the pressure of the spring 62 becomes smaller than the resultant force of the atmospheric pressure and the pressure of the spring 56. This causes the diaphragm 53 to shift and in turn cause the spherical valve member 65 to move away from the valve seat via the rod 63 so as to open the valve hole 72*b*. As a result, a high-pressure refrigerant gas in the discharge chamber 31 is introduced into the crank chamber 5 via a communicating hole 91, the distal end portion of the compartment 93, the port 72*a*, the discharge pressure chamber 72, the valve hole 72*b*, the port 73*a*, the central portion of the compartment 93, and the refrigerant gas supplying passage 95. The refrigerant flow resistance of the bleed passage 35 is set so that the amount of the high-pressure refrigerant gas introduced into the crank chamber 5 is greater than the amount of refrigerant gas discharged into the suction chamber 30 via the bleed passage 35. This causes the crank chamber pressure Pc to gradually rise, and the difference between the crank chamber pressure Pc and the suction pressure Ps increases.

As the crank chamber pressure Pc increases as mentioned above, the back pressure applied to the pistons 9 increases, and the inclination of the swash plate 12 decreases and the stroke of each piston 9 decreases as well, causing the compressor to shift to a small-capacity control operation. Then, as the suction pressure Ps drops according to the balance between thermal load and refrigerating capacity, the inclination of the swash plate decreases until the swash plate comes in contact with the circlip 22.

If the balance between the refrigerating capacity and the refrigeration load in the small-capacity control operation is disturbed and the refrigeration load surpasses the refrigerating capacity, then the suction pressure Ps increases. At this time, the spherical valve member 65 moves toward the diaphragm 53, as in the case of starting up the compressor, so as to close the valve hole 72*b* in the capacity control valve assembly 50. Hence, the supply of the high-pressure refrigerant gas from the discharge chamber 31 into the crank chamber 5 is cut off, so that the pressure in the crank chamber drops, and the inclination of the swash plate 12 is increased to increase the refrigerating capacity of the compressor.

Figure 5:
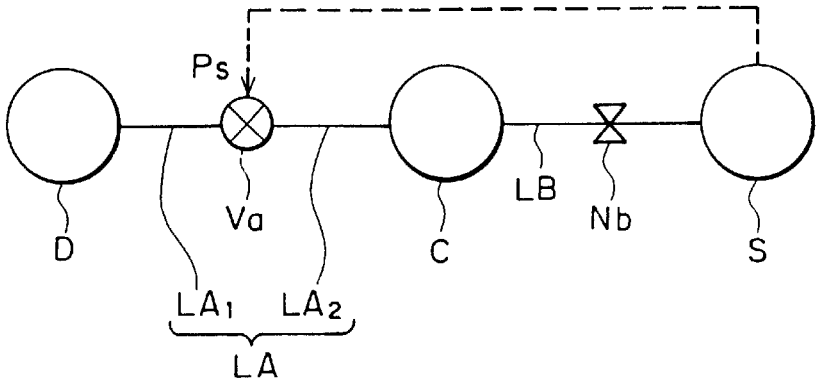
FIG. 5 PRIOR ART
FIG. 5 is a schematic control diagram associated with a first control system.

FIG. 5 schematically illustrates a control system implemented with the foregoing capacity control valve assembly 50. More specifically, a discharge pressure area D of the discharge chamber 31 or the like is connected to a crank chamber area C in the crank chamber 5 via a communicating passage LA, and the crank chamber area c is connected to a suction pressure area S of the suction chamber 30 or the like via a communicating passage LB. The capacity control valve assembly of this type is characterized in that the communicating passage LA is provided with an opening/closing mechanism Va which opens and closes according to a change in the suction pressure, and that the communicating passage LB is provided with a throttle Nb. The control system shown in the schematic control diagram will be hereinafter referred to as a first control system. The throttle Nb is not especially necessary if the refrigerant flow resistance of the communicating passage LB itself is set to a high value.

Here, comparing FIG. 1 to FIG. 4 to the schematic control diagram of the first control system indicates that a portion LA, of the communicating passage LA corresponds to the communicating hole 91, the distal end portion of the compartment 93, the port 72*a*, and the discharge pressure chamber 72. The opening/closing mechanism Va corresponds primarily to the valve hole 72*b* and the spherical portion 65. A portion $LA_2$ of the communicating passage LA corresponds to the port 73*a*, the central portion of the compartment 93, and the refrigerant gas supplying passage 95. The communicating passage LB and the restrictor Nb correspond to the bleed passage 35 and the throttle 35*a*.

Figure 6:
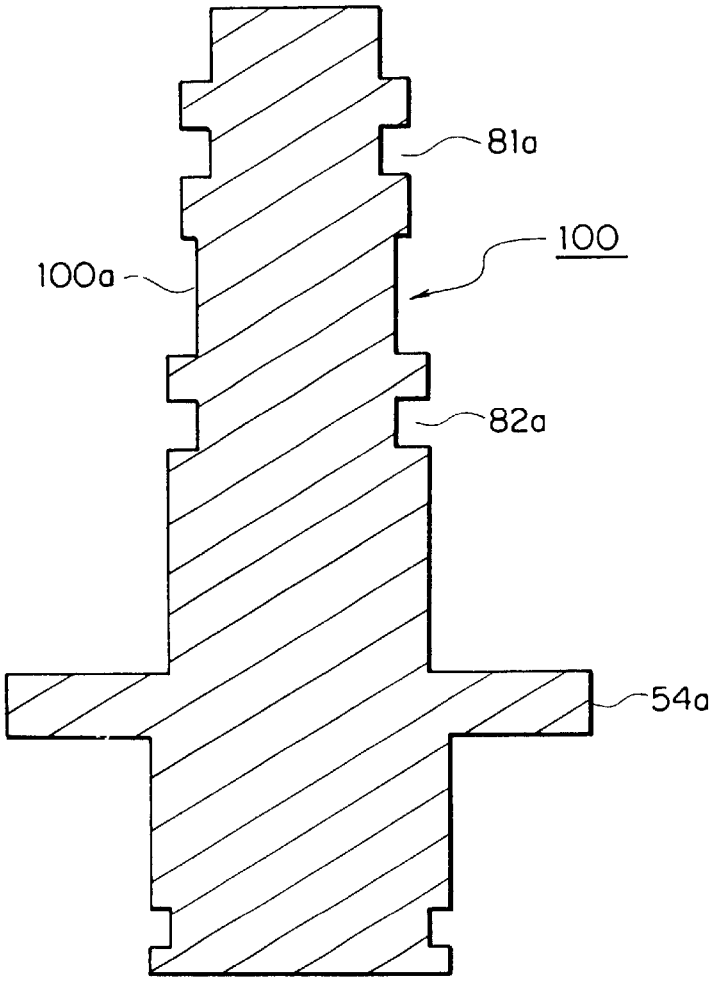
FIG. 6 shows a cock member in accordance with the first embodiment.

In the first embodiment of the present invention, the capacity control valve assembly 50 described above has been replaced by a cock member 100, as shown in FIG. 6, for maintaining the crank chamber pressure at the suction pressure.

FIG. 6 shows the cock member 100 which replaces the capacity control valve assembly 50 and which has a main body 100*a* that has been cut out from a bar-shaped material according to the profile of the capacity control valve assembly 50. The main body 100*a* has gone through no machining such as boring inside; it is constituted as a completely solid body, so that it has much simpler structure than the capacity control valve assembly 50, thus permitting lower cost. The O ring grooves 81*a* and 82*a* have been machined such that they are located at the same positions and have the same sizes as those in the capacity control valve assembly 50. Furthermore, the surface of a flange 54*a* is able to accommodate the O ring 83 provided on the plane of the stepped portion on the inlet side of the compartment 93 or the fixing ring 85 for fixing the capacity control valve assembly 50 without making any changes.

Figure 7:
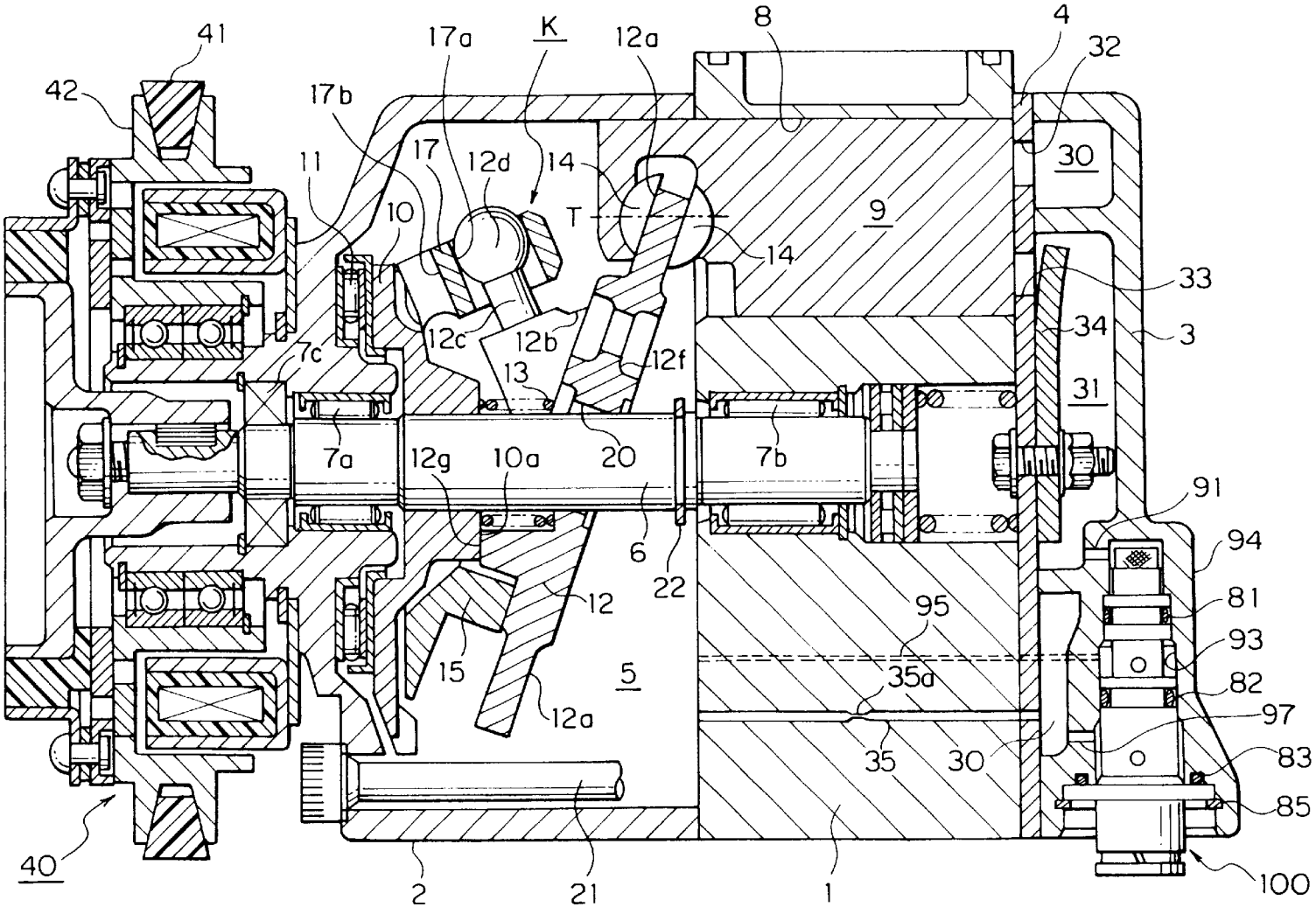
FIG. 7 is a longitudinal sectional view showing a fixed capacity swash plate type compressor in accordance with the first embodiment.

Hence, the fixed capacity swash plate type compressor can be assembled in a manner similar to that for assembling the variable capacity swash plate type compressor. More specifically, the cock member 100 may be installed in the same manner as the capacity control valve assembly 50. FIG. 7 is a longitudinal sectional view showing a swash plate type compressor in which the cock member 100 has been installed in place of the capacity control valve assembly 50 as mentioned above. FIG. 7 corresponds to FIG. 1; the compressor shown in FIG. 7 has the O rings 81, 82, and 83 as in the case of the compressor shown in FIG. 1. This means that the distal end portion and the central portion of the compartment 93 are airtightly partitioned from each other, and the intake portion of the compartment 93 is also airtightly sealed against the atmosphere outside the compressor. In other words, the main body 10*a* functions as a closing body that cuts off the communication between the crank chamber 5 and the discharge chamber 31 in the compartment 93 at all times regardless of a change in the suction pressure.

The configuration discussed above always cuts off the communication between the discharge chamber 31 and the crank chamber 5 independently of a change in the suction pressure, whereas it maintains the communication between the crank chamber 5 and the suction chamber 30 all times through the bleed passage 35. Therefore, by setting the refrigerant flow resistance of the bleed passage 35 at a sufficiently high value so that a blowby gas can be sufficiently discharged, the blowby gas leaking from the cylinder bores 8 into the crank chamber 5 during operation will be sufficiently discharged from the crank chamber 5, and the crank chamber 5 is always maintained at a pressure nearly equal to the suction pressure Ps. As a result, during steady operation, the back pressure applied to the pistons 9 always stays low, and a compression reaction force, which is applied to the swash plate 12 via the pistons 9 and which generates a moment in a direction that increases the inclination of the swash plate, causes the swash plate 12 to swing against the spring 13 toward the maximum inclination angle. Thus, the swash plate 12 is always maintained at its maximum inclination angle during steady operation.

On the other hand, at the time of startup, since the high and low pressures in the refrigerant circuit are balanced while the compressor is at rest, the swash plate 12 has been pushed to the circlip 22 side by the pressing force of the spring 13. Therefore, the swash plate 12 is at the minimum inclination. When the compressor is started up under this condition, the discharge pressure Pd quickly increases, while the suction pressure Ps drops, and the inclination of the swash plate 12 increases as these pressures change. Thus, the fixed capacity swash plate type compressor configured as described above does not incur a sudden change in pressure which is observed in the conventional fixed capacity swash plate type compressor when starting up the compressor, so that startup shock can be suppressed. Moreover, the same assembly line for the variable capacity swash plate type compressor can be used for the fixed capacity swash plate type compressor. More specifically, both the fixed capacity type and the variable capacity type can be assembled on the same line by selectively installing either the capacity control valve assembly 50 or the cock member 100 according to the specifications of individual compressors. Hence, both the fixed capacity type swash plate compressor and the variable capacity type swash plate compressor can be assembled on the same line using the same procedure.

A second embodiment will now be described in conjunction with FIG. 8. In the second embodiment, the cock member 100 for maintaining the crank chamber pressure at the suction pressure has been replaced by a cock member 110 shown in FIG. 8.

The cock member 110 has exactly the same function and appearance as the cock member 100; however, it differs from the cock member 100 in that a bottomed, stepped bore 111 has been provided in an inner portion of a main body 110*a* in order to reduce the weight of the cock member. The cock member 110, therefore, has a much more simple structure than the capacity control valve assembly 50 and accordingly is cheaper. The same assembly procedure as that for the cock member 100 can be used, hence it can be assembled in exactly the same manner as the capacity control valve assembly 50. The operation of the compressor incorporating the cock member 110 is also exactly the same as that in the first embodiment.

Figure 9:
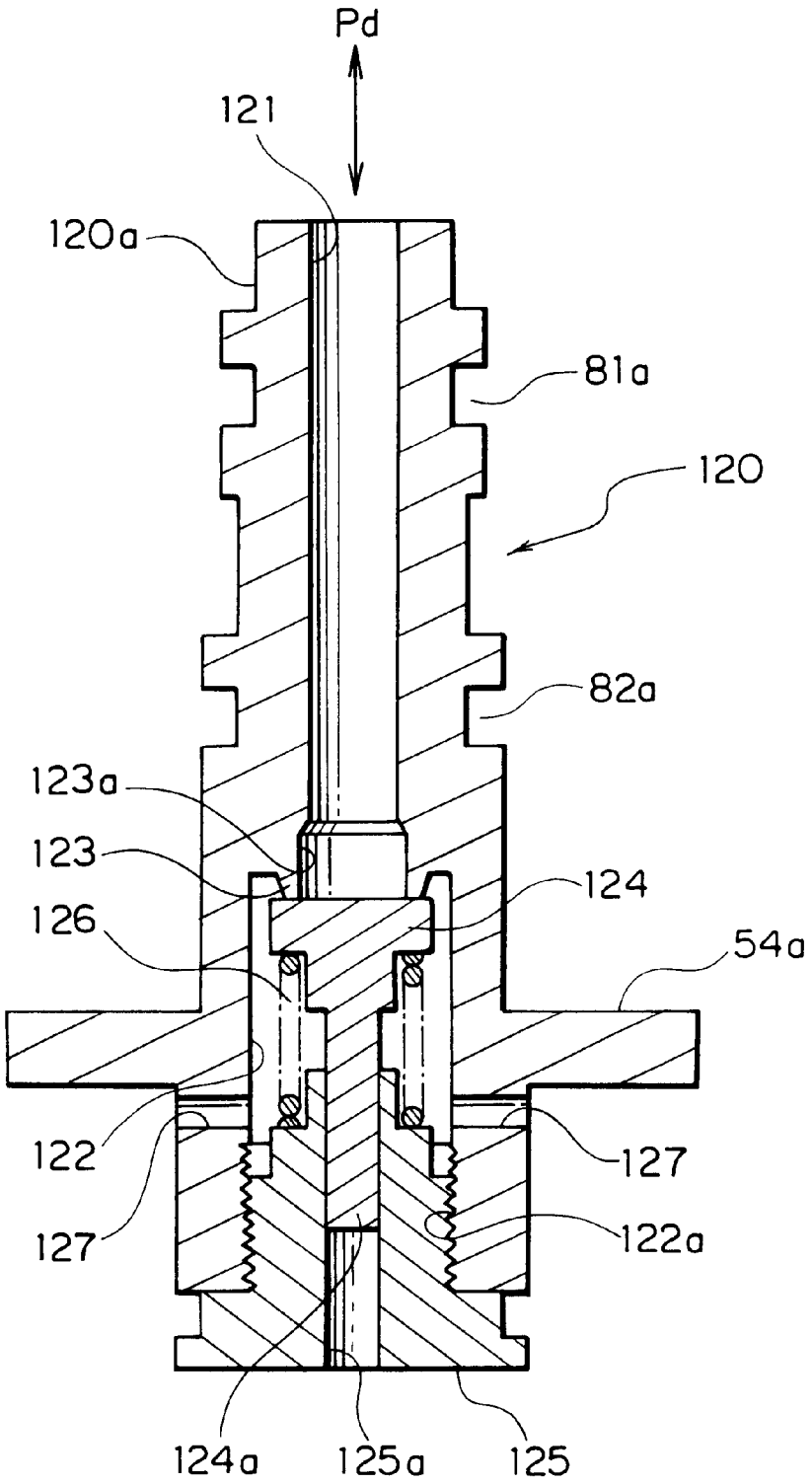
FIG. 9 is a cock member in accordance with a third embodiment.

Referring now to FIG. 9, a third embodiment will be described. In the third embodiment, the cock member 100 for maintaining the crank chamber pressure at the suction pressure has been replaced by a cock member 120 shown in FIG. 9.

The cock member 120 has exactly the same function and appearance as the cock member 100; however, it differs from the cock member 100 in that a relief valve mechanism communicated with the distal end of the compartment 93 is provided therein.

An example of the relief valve mechanism is shown in FIG. 9. In a valve main body 120*a* shown in FIG. 9, a stepped bore 121 having the distal end thereof opened is formed at the distal end side of a valve main body 120*a*, and a valve chamber 122 is formed at the inlet side. The valve chamber 122 has a threaded portion 122*a* which is formed at the inlet thereof and into which a retaining fixture 125 is screwed. The valve chamber 122 is fixed by screwing the retaining fixture 125 into the threaded portion 122*a*. A valve hole 123*a* is formed in the bottom wall member of the valve chamber 122, a valve seat 123 is formed around the valve hole 123*a*, and a valve member 124, which is seated on the valve seat 123, is provided in the valve chamber 122. Fixed in the valve member 124 is a rod 124*a* which is slidably inserted in a central bore 125*a* of the retaining fixture 125. Further, a coil type safety spring 126 that urges the valve member 124 toward the valve seat 123 is installed between the valve member 124 and the retaining fixture 125. The side wall of the valve chamber 122 is provided with a plurality of communication holes 127 located between the threaded portion 122*a* and a flange 54*a*.

The cock member 120 equipped with the relief valve mechanism described above is installed in the compartment 93 of the rear housing 3 of the compressor according to the same procedure as that for the capacity control valve assembly 50 or the cock member 100 and 110.

In the fixed capacity swash plate type compressor thus assembled, the communication between the crank chamber 5 and the discharge chamber 31 in the compartment 93 is always cut off by the valve main body 120*a* regardless of a change in the suction pressure. On the other hand, if the discharge pressure Pd should increase and exceed a preset value due to some malfunction, then the discharge pressure overcomes the urging force of the safety spring 126 and causes the valve member 124 to move toward the inlet against the safety spring 126 to open the valve hole 123*a*. This, in turn, causes the discharge chamber 31 to be brought in communication with the outside of the compressor via the communicating hole 91, the distal end portion of the compartment 93, the stepped bore 121, the valve hole 123*a*, the valve chamber 122, and the communication holes 127, thus releasing the abnormally high discharge pressure Pd to the outside of the compressor. Hence, installing the cock member 120 obviates the need for providing the fixed capacity swash plate type compressor of this embodiment with any separate relief valve, which contributes to a reduction in cost.

A fourth embodiment will now be described in conjunction with FIGS. 10 through 12. The fourth embodiment has been invented based on a variable capacity swash plate type compressor wherein the port 72*a* in the distal end portion of the capacity control valve assembly 50 faces an oil reservoir for storing a lubricant that has been separated from a discharged gas. In the fourth embodiment, a cock member that has an oil return hole is installed in place of the capacity control valve assembly 50.

First, a description will be made of a specific example wherein the distal end portion of the capacity control valve assembly 50, which is the same one as that shown in FIG. 4, faces the oil reservoir. There has been disclosed, for example, in Japanese Patent Application Laid-open No. 8-42453, a known conventional example similar to this specific example. This will be described with reference to FIG. 10 and FIG. 11. The description will be focused mainly on the aspects that differ from those which have been discussed in conjunction with FIG. 1 to FIG. 4.

Figure 10:
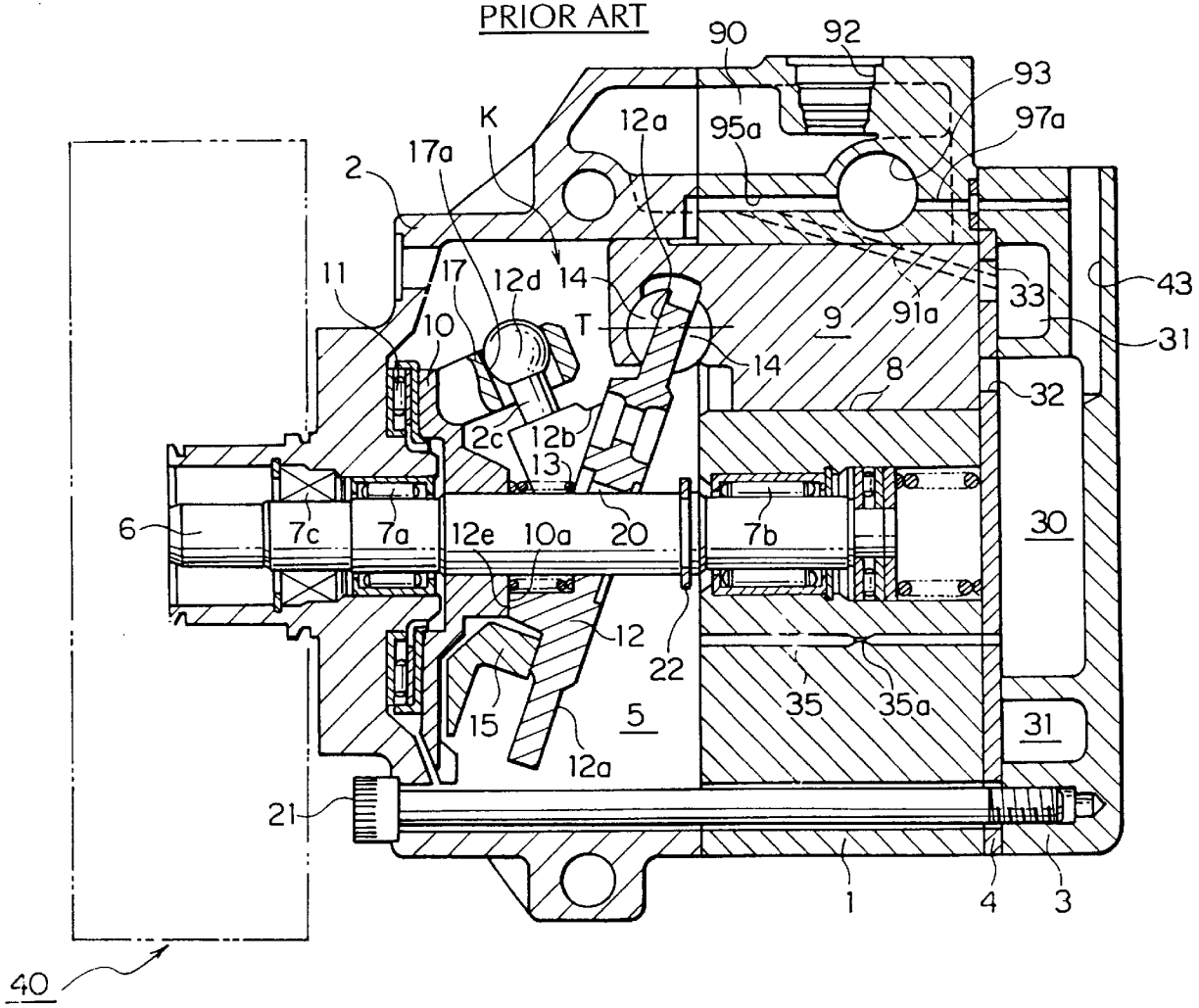
FIG. 10 PRIOR ART
FIG. 10 is a longitudinal sectional view showing a conventional variable capacity swash plate type compressor of a fourth embodiment.
Figure 11:
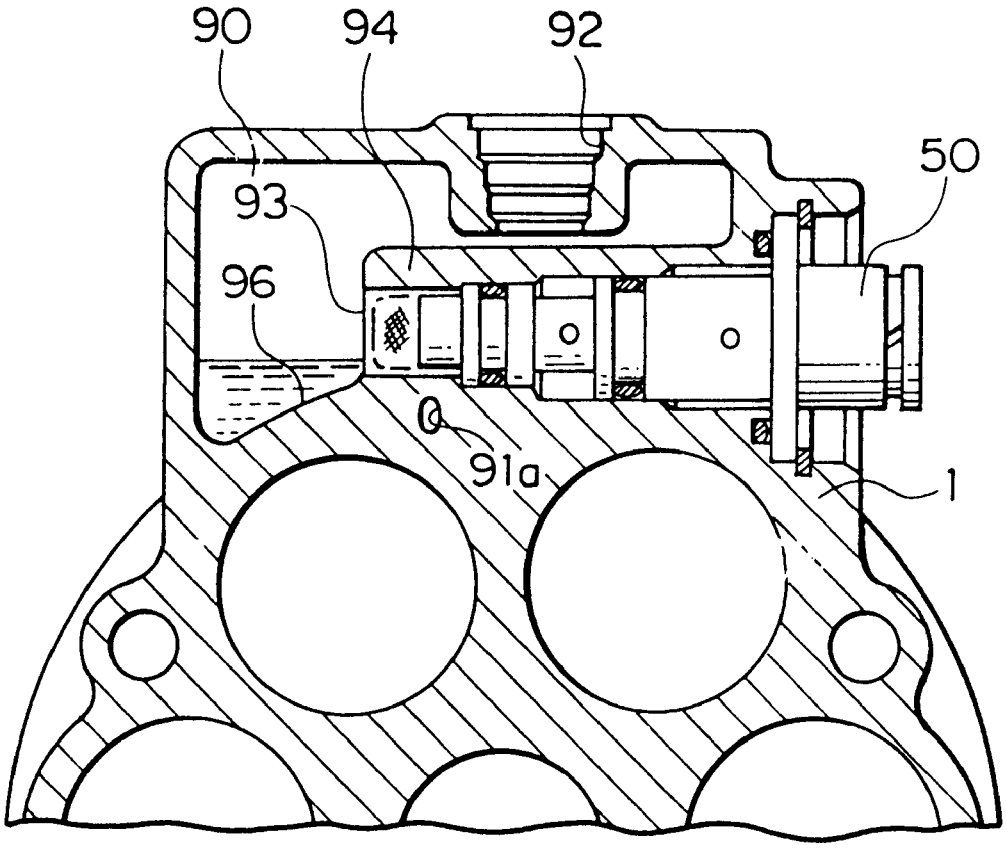
FIG. 11 PRIOR ART
FIG. 11 is a sectional view showing the vicinity of a capacity control valve assembly of the swash plate type compressor shown in FIG. 10.
Figure 12:
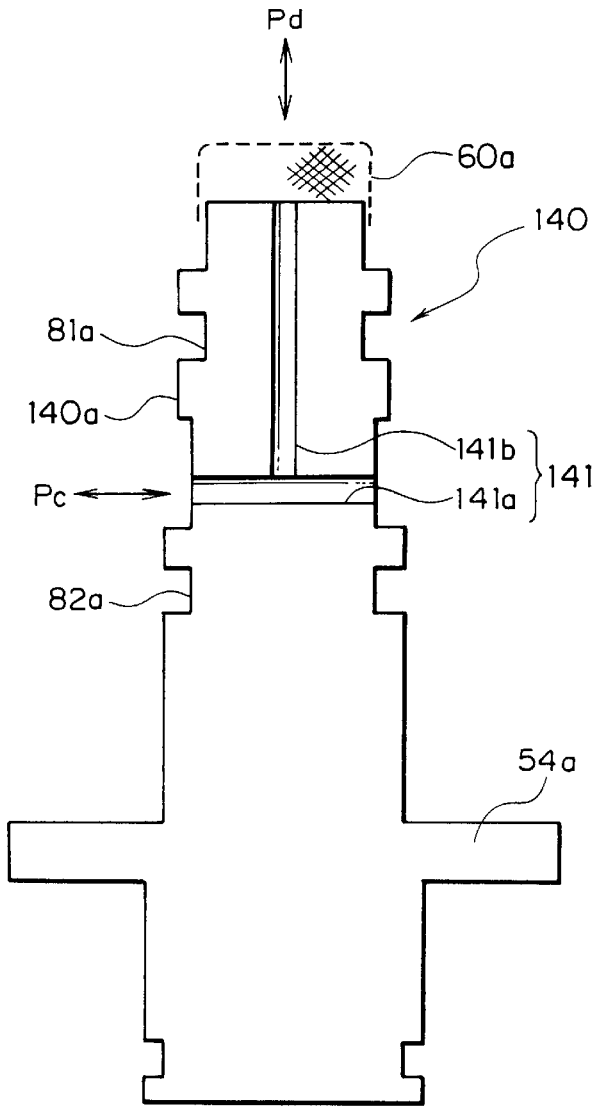
FIG. 12 shows a cock member in accordance with the fourth embodiment.

In FIG. 10 and FIG. 11, a discharge muffler 90 is formed to span both an outer shell of the cylinder block 1 and the front housing 2. The discharge muffler 90 is communicated with a discharge chamber 31 through a passage 91*a* and connected to an external refrigerant circuit, not shown, via a discharge hole 92. Formed inside the discharge muffler 90 is a bulge portion 94 which is equipped with a compartment 93 for holding a capacity control valve assembly 50 and which is oriented orthogonally to the axial center of the compressor. The distal end portion of the compartment 93 is opened to an oil reservoir 96 formed in the discharge muffler 90. A refrigerant gas supplying passage 95*a* has one end thereof in communication with a port 73*a* of the capacity control valve assembly 50 via the central portion of the compartment 93, and the other end thereof in communication with the crank chamber 5. A pressure detection passage 97*a* has one end thereof in communication with a port 71*a* of the capacity control valve assembly 50 via the inlet of the compartment 93, and the other end thereof in communication with a suction inlet 43 provided in a rear housing 3.

Thus, in the variable capacity swash plate type compressor configured as described above, when the suction pressure Ps drops, the displacement of the diaphragm 53 causes the spherical valve member 65 to move away from the valve seat to open the valve hole 72*b* in FIG. 4. As a result, a high-pressure discharge refrigerant gas in the discharge muffler 90 is introduced into the crank chamber 5 to increase the crank chamber pressure Pc thereby reducing the inclination of the swash plate 12 and the stroke of the pistons, which causes the compressor to shift to the small-capacity operation control. At this time, the lubricant is returned, together with the discharged refrigerant gas, to the crank chamber 5 from the oil reservoir 96.

The fourth embodiment is intended to modify the variable capacity swash plate type compressor to a fixed capacity swash plate type compressor. In the fourth embodiment, the cock member 140, shown in FIG. 12, for maintaining the crank chamber pressure at the suction pressure is installed in the compartment 93.

The cock member 140 has the same crank chamber pressure control system as that of the cock member 100 in the first embodiment, but it differs from the cock member 100 in that it has an oil return hole.

More specifically, the cock member 140 has exactly the same appearance as the capacity control valve assembly 50 in the first through third embodiments.

The cock member 140 is provided with an oil return passage 141 which is located inside a main body 140*a* and which is composed of a through hole 141*a* of a small diameter provided at the position of the port 73*a*, and a communicating hole 141*b* of a small diameter that extends from a distal end surface of the cock member 140 to the through hole 141*a*. The oil return passage 141 is formed with a small diameter to provide a sufficiently high refrigerant flow resistance with respect to the bleed passage 35.

The procedure for installing the cock member 140 is exactly the same as that for the capacity control valve assembly 50.

When the cock member 140 has been installed in the compartment 93, the oil reservoir 96 of the discharge muffler 90 and the crank chamber 5 are in communication via the oil return passage 141 at all times, and the lubricant is returned, with a small amount of a discharged gas in the discharge muffler 90, to the crank chamber 5. Hence, it is not necessary to provide the compressor of this embodiment with oil return mechanism separately.

The oil return passage 141 may be provided with a resistor located midway therein instead of making the diameter thereof sufficiently small as long as the oil return passage 141 provides a sufficiently high refrigerant flow resistance so that the pressure in the crank chamber 5 is not increased due to the discharged gas returned to the crank chamber 5.

Thus, by setting the refrigerant flow resistance of the oil return passage 141 at a high level, the pressure in the crank chamber 5 is maintained at the suction pressure Ps as in the first embodiment. This makes it possible to operate the compressor as a fixed capacity swash plate type compressor having the swash plate 12 thereof fixed at a maximum inclination.

As described above, according to the fourth embodiment, a less expensive cock member 140 can be employed, and a reduction in cost can be achieved by using common components and common production control. Moreover, the cock member 140 also serves as the oil return mechanism, resulting in a further reduction in cost as in the first through third embodiments discussed above.

Figure 13:
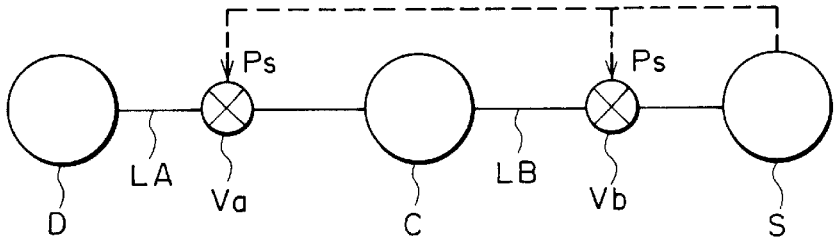
FIG. 13 is a schematic control diagram in accordance with a second control system.
Figure 14:
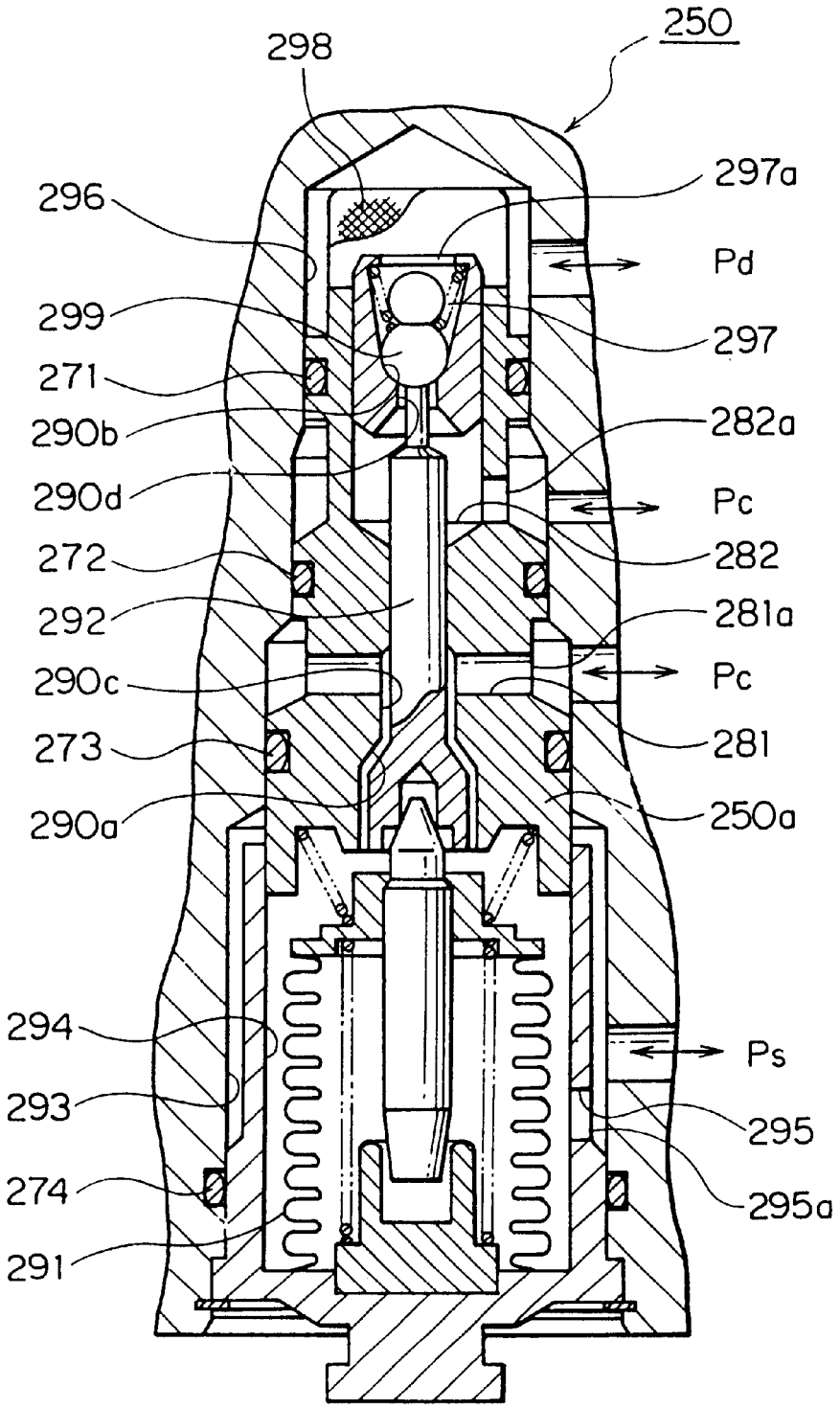
FIG. 14 PRIOR ART
FIG. 14 is a sectional view showing a capacity control valve assembly in a conventional variable capacity swash plate type compressor in accordance with a fifth embodiment.
Figure 15:
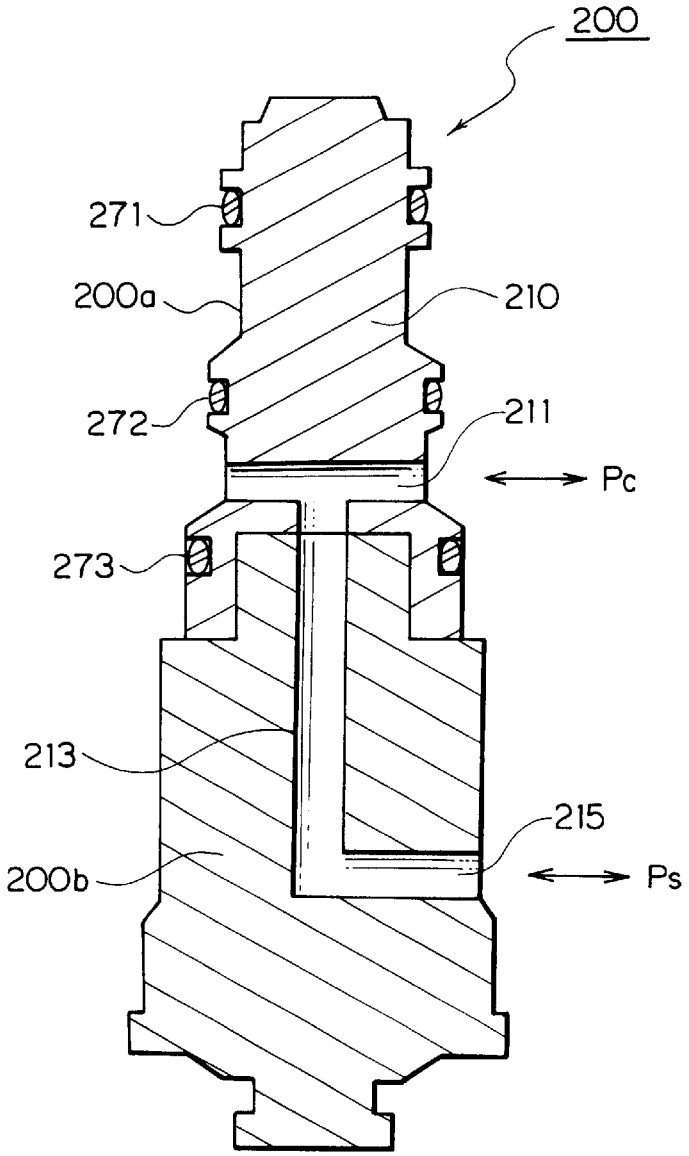
FIG. 15 is a cock member in accordance with the fifth embodiment.

Referring now to FIG. 13 to FIG. 15, a fifth embodiment will be described. The fifth embodiment is based on a variable capacity swash plate type compressor equipped with a capacity control valve assembly of a second control system illustrated by the schematic control diagram shown in FIG. 13. According to the second control system, an opening/closing mechanism Va that opens or closes according to a change in the suction pressure is installed in a communicating passage LA that allows communication between a discharge pressure area D and a crank chamber area C, and an opening/closing mechanism Vb which opens or closes according to a change in the suction pressure and which opens or closes reactively in relation to the opening/closing mechanism Va is installed in a communicating passage LB that allows communication between the crank chamber area C and a suction pressure area S.

Figure 8:
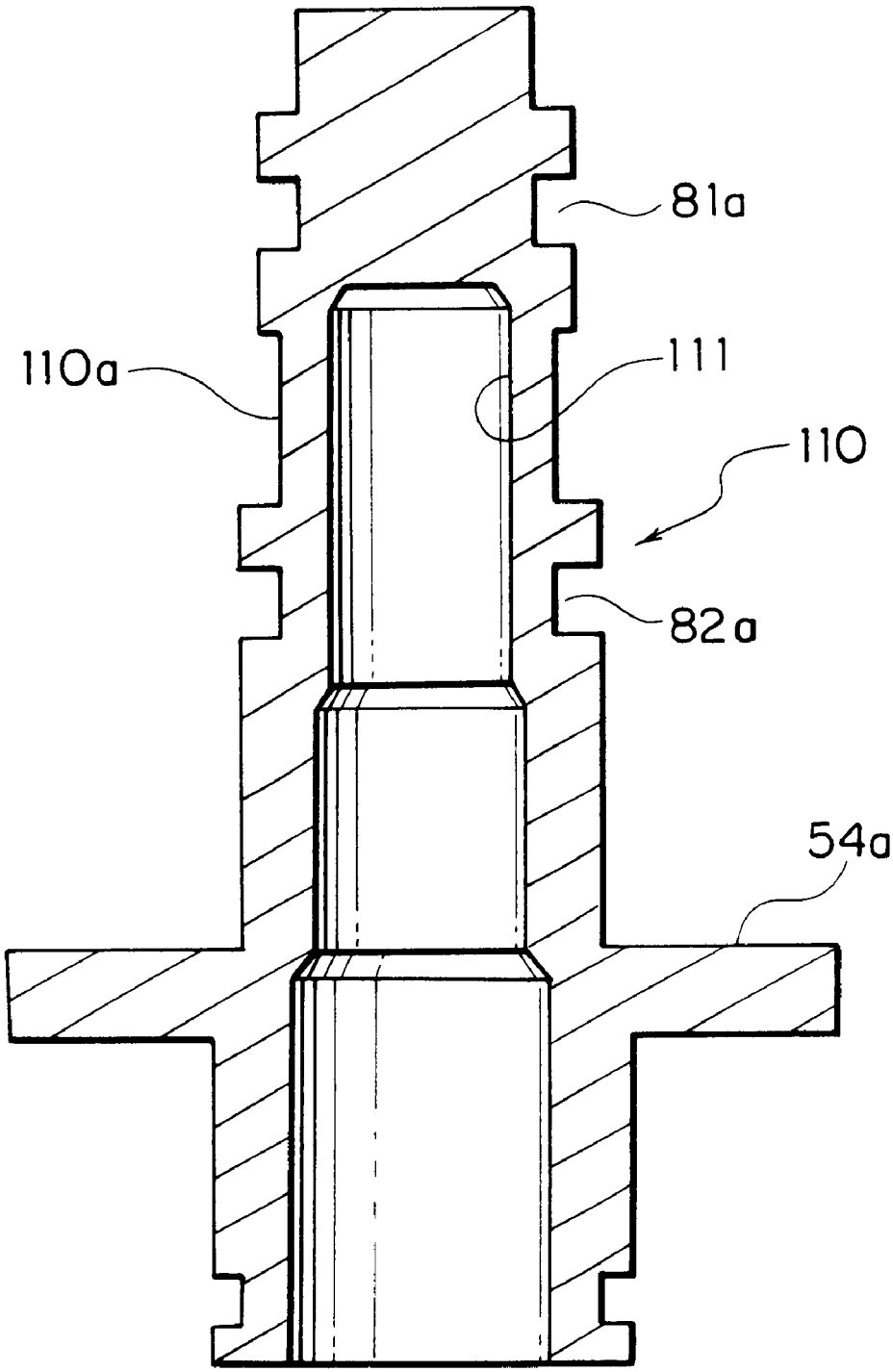
FIG. 8 is a cock member in accordance with a second embodiment.

A specific example is disclosed in FIG. 8 in Japanese Patent Application Laid-open Publication No. 6-336978. The variable capacity swash plate type compressor described in this publication is typical except for its capacity control valve assembly, and the embodiment is related only to the capacity control valve assembly; therefore, for the purpose of simplicity of description, only the capacity control valve assembly will be shown in FIG. 14 to describe the structure and control details thereof.

A capacity control valve assembly 250 is provided with a low-pressure chamber 294 located at the inlet of a valve main body 250*a*. A bellows 291 serving as a pressure sensing means is installed in the low-pressure chamber 294 such that it may expand or contract. In the bellows 291, a rod-shaped valve member 292 as a first valve main body extends into the low-pressure chamber 294, and a snowman-shaped valve member 299 as a second valve member is coupled to the rod-shaped valve member 292. The low-pressure chamber 294 is formed around the bellows 291 and configured to communicate with a suction pressure area S of a suction chamber (not shown) or the like via a low-pressure passage 295 and a low-pressure port 295*a* so as to apply a suction pressure Ps to the periphery of the bellows 291. The valve main body 250*a* is further provided with a low-pressure valve hole 290*c* formed between the low-pressure chamber 294 and a control passage 281, which is formed as a through hole at a central portion of the valve main body 250*a*. A low-pressure valve seat 290*a* is formed around the circumferential edge of the low-pressure pressure valve hole 290*c*. When the bellows 291 expands, the rod-shaped valve member 292 moves to be seated on the low-pressure valve seat 290*a*. This valve mechanism corresponds to the opening/closing mechanism Vb in the schematic control diagram shown in FIG. 13.

A high-pressure chamber 296 is formed at the distal end portion of the valve main body 250*a*. The high-pressure chamber 296 communicate with a discharge pressure area D of a discharge chamber (not shown) or the like. A high-pressure valve hole 290*d* is formed between the high-pressure chamber 296 and a control chamber 282 formed at the central portion of the valve main body 250*a*, and a high-pressure valve seat 290*b* is formed at the peripheral edge of the high-pressure valve hole 290*d*. When the bellows 291 contracts, the snowman-shaped valve member 299 moves together with the rod-shaped vale body 292 to be seated on the high-pressure valve seat 290*b*. This valve mechanism corresponds to the opening/closing mechanism Va in the schematic control diagram shown in FIG. 13.

The high-pressure chamber 296 is further provided with a mesh member 298 which covers a high-pressure port 297*a* and which serves as a filtering means.

The control passage 281 formed at a middle of the valve main body 250*a* and the control chamber 282 are in communication with a crank chamber area C via control ports 281*a* and 282*a*.

O rings 271, 272, 273, and 274 are installed to maintain airtightness between the high-pressure chamber 296, the control chamber 282, the control passage 281, and the low-pressure chamber 294, respectively or to maintain airtightness of the compressor with respect to the outside.

In the variable capacity swash plate type compressor incorporating the capacity control valve assembly 250 constructed as discussed above, if the suction pressure Ps is higher than a predetermined value, then the bellows 291 contracts and the rod-shaped valve member 292 moves away from the low-pressure valve seat 290*a* in the capacity control valve assembly 250. This causes the low-pressure passage 295 to communicate with the control passage 281 so as to lead the refrigerant gas in the crank chamber area C into the suction pressure area S via the control port 281*a*, the control passage 281, the low-pressure valve hole 290*c*, the low-pressure chamber 294, the low-pressure passage 295, and the low-pressure port 295*a*. At the same time, the snowman-shaped valve member 299 moves together with the rod-shaped valve member 292 to be seated on the high-pressure valve seat 290*b*. This shuts off the communication between the high-pressure passage 297 and the control chamber 282, preventing the refrigerant gas in the discharge pressure area D from being introduced to the crank chamber area C. Thus, in the compressor, the crank chamber pressure Pc drops and the back pressure applied to the pistons drops accordingly. As a result, the inclination of the swash plate increases as does the stroke of each piston, and the discharge capacity is increased.

On the other hand, if the suction pressure Ps drops down to the predetermined value, the bellows 291 expands to cut off the communication between the low-pressure passage 295 and the control passage 281 in the capacity control valve assembly 250 so that the refrigerant gas in the crank chamber area C is not led into the suction pressure area S. At the same time, the snowman-shaped valve member 299 moves together with the rod-shaped valve member 292 away from the high-pressure valve seat 290*b*. This causes the high-pressure passage 297 to be communicated with the control chamber 282, thereby introducing the refrigerant gas in the discharge pressure area D into the crank chamber area C via the mesh member 298, the high-pressure port 297*a*, the high-pressure passage 297, the high-pressure valve hole 290*d*, the control chamber 282, and the control port 282*a*. Thus, in the compressor, the crank chamber pressure Pc increases and the inclination of the swash plate decreases; therefore, the stroke of each piston becomes smaller and the discharge capacity is decreased.

The variable capacity swash plate type compressor incorporating the capacity control valve assembly 250 is designed as described above to carry out the capacity control.

A fixed capacity swash plate type compressor in accordance with a fifth embodiment is based on the variable capacity swash plate type compressor discussed above. More specifically, in the fifth embodiment, a cock member 200 for maintaining the crank chamber pressure at the suction pressure as shown in FIG. 15 is installed in a compartment 293, which holds the capacity control valve assembly 250, in place of the capacity control valve assembly 250. For the purpose of simplifying the explanation, the configuration of the entire compressor is omitted. Except for the cock member 200, the configuration of the compressor of this embodiment is identical to that of the variable capacity swash plate type compressor incorporating the conventional capacity control valve assembly 250.

The cock member 200 shown in FIG. 15 is comprised of a first main body 200*a* and a second main body 200*b* which are joined with each other, which makes the exterior of the cock member 200 look just like the capacity control valve assembly 250. The main body 200*a* is provided with O ring mounting grooves that accommodate O rings 271, 272, and 273. In the cock member 200, a control passage 211 and a low-pressure passage 215 are provided at the positions where the control passage 281 and the low-pressure passage 295 are located in the capacity control valve assembly 250. These passages 211 and 215 are connected through a communicating passage 213 disposed at an axial portion such that they are in communication at all times regardless of a change in the suction pressure. Hence, the cock member 200 has a much simpler construction and is cheaper than the capacity control valve assembly 250. Further, by installing the cock member 200 in place of the capacity control valve assembly 250, the communication of the communicating passage LA in the schematic control diagram of FIG. 13 remains cut off by the main body 200*a* independently of a change in the suction pressure, on the other hand, the communicating passage LB in the schematic control diagram of FIG. 13 remains in communication by the passages 211, 213, and 215, independently of a change in the suction pressure.

Since the fifth embodiment is constructed as described above, the crank chamber area C is always in communication with the suction pressure area S and maintained at the suction pressure Ps. Therefore, as in the case of the first embodiment, the swash plate starts to rotates at the minimum inclination at the time of startup, and the inclination increases as the difference between the high pressure and the low pressure increases. Thus, during steady operation, the swash plate is fixed at the maximum inclination.

Thus, the fixed capacity swash plate type compressor of the fifth embodiment discussed above also permits a reduction in cost by employing the inexpensive cock member 200 as in the case of the first embodiment. In addition, further reduction in cost is possible by using the components and production control system common to those of the variable capacity swash plate type compressor.

Figure 16:
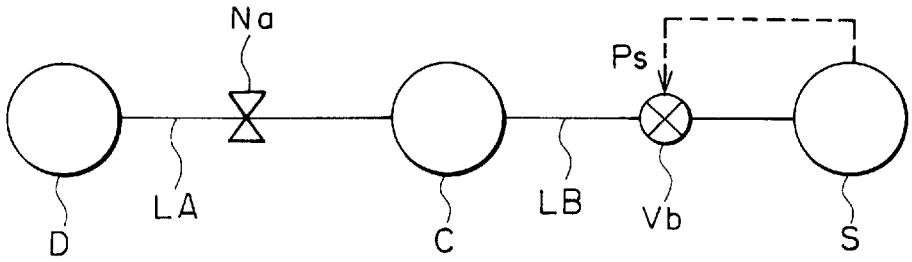
FIG. 16 is a schematic control diagram in accordance with a third control system.
Figure 17:
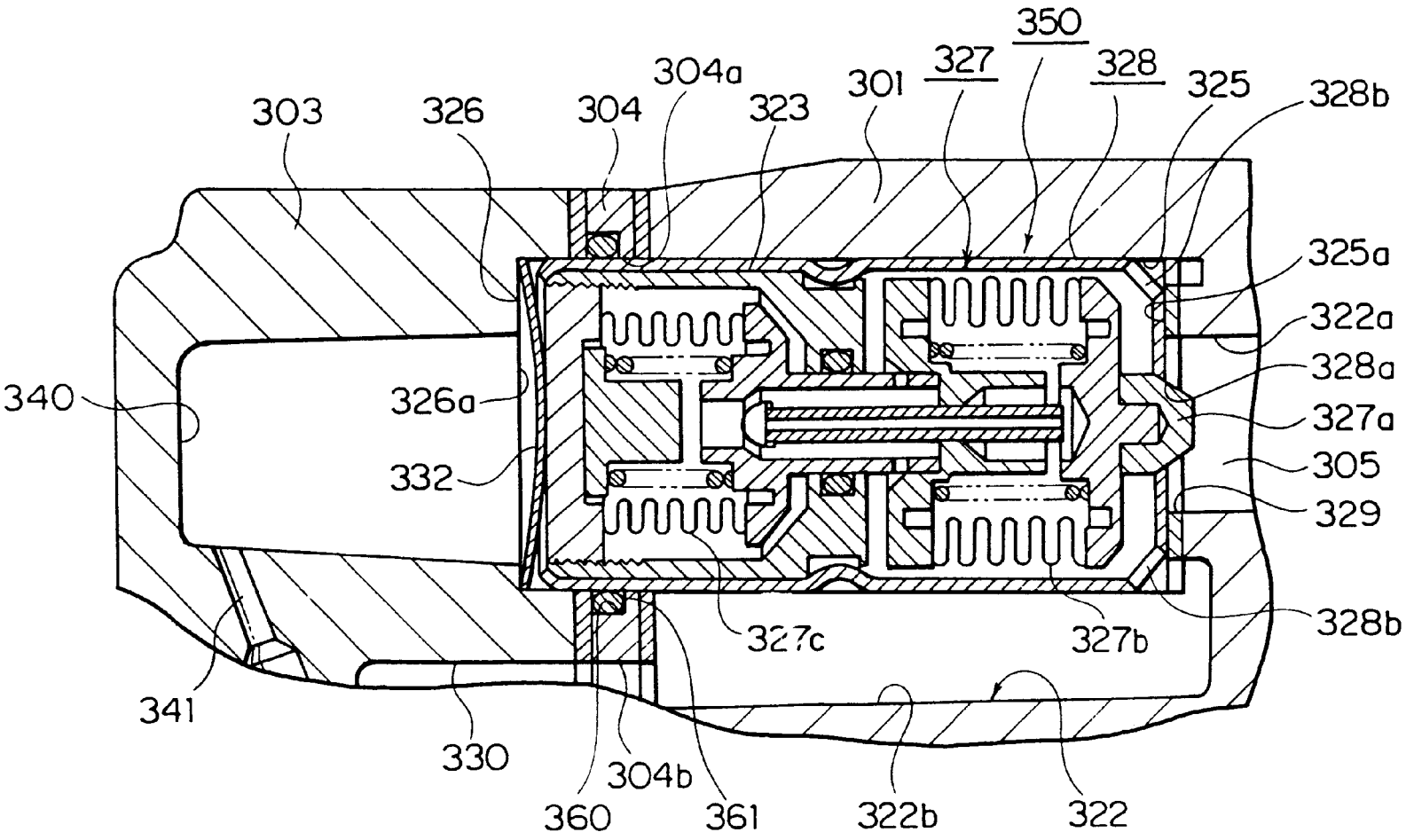
FIG. 17 PRIOR ART
FIG. 17 is a sectional view showing a capacity control valve assembly in a conventional variable capacity swash plate type compressor in accordance with a sixth embodiment.
Figure 18:
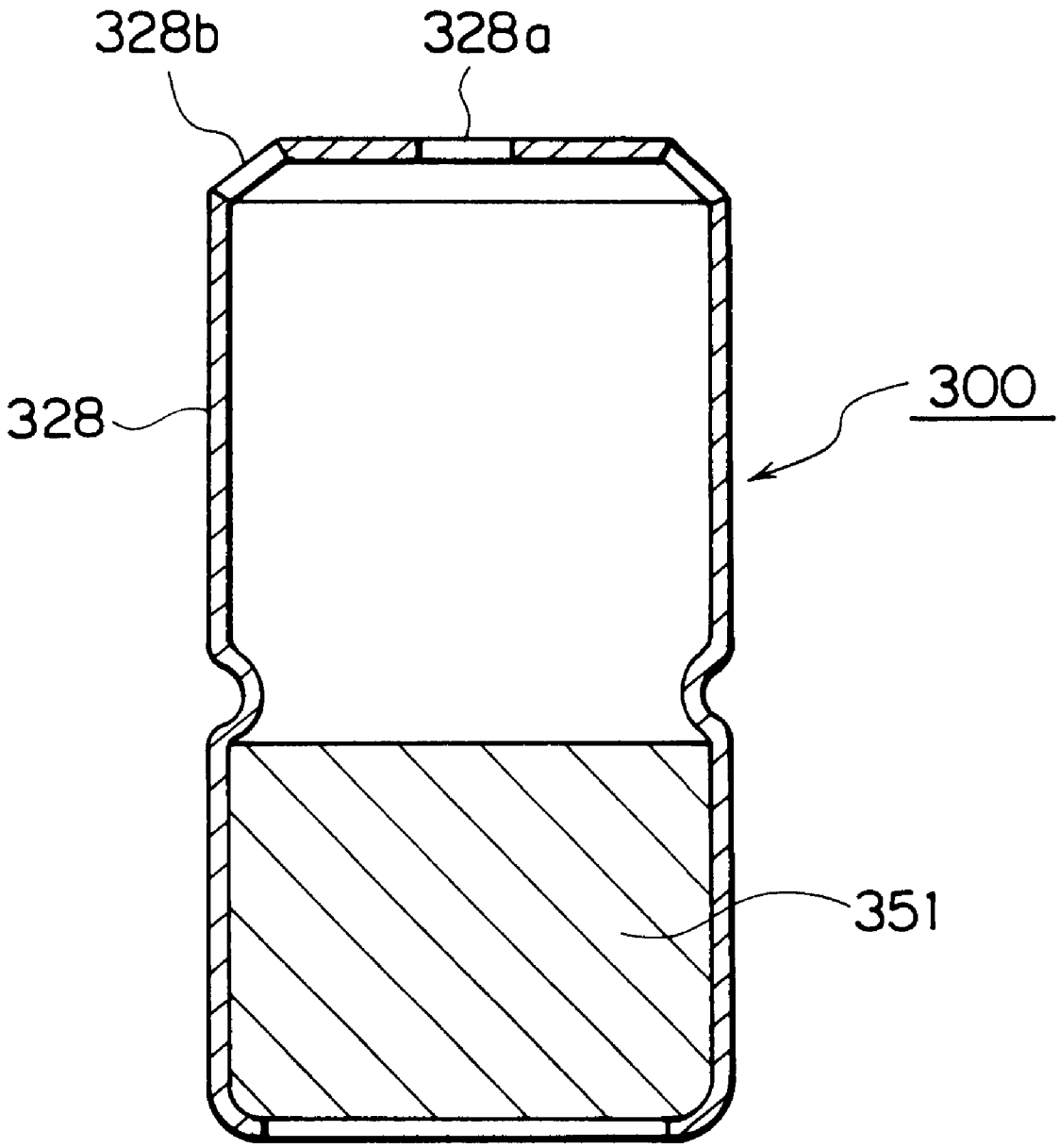
FIG. 18 is a cock member in accordance with the sixth embodiment.

Referring now to FIGS. 16 to 18, a sixth embodiment will be described. The sixth embodiment is based on a variable capacity swash plate type compressor equipped with a capacity control valve assembly of a third control system as shown in a schematic control diagram of FIG. 16. In the third control system, a throttle Na is installed in a communicating passage LA that allows communication between a discharge pressure area D and a crank chamber area C, and an opening/closing mechanism Vb that opens or closes according to a change in the suction pressure Ps is installed in a communicating passage LB that allows communication between the crank chamber area C and the suction pressure area S.

A specific example of the above is disclosed, for example, in FIG. 6 of Japanese Application Laid-open Patent No. 9-287563. Except for its control valve assembly, the variable capacity swash plate type compressor discussed in the publication is a typical compressor and the embodiment is related only to the capacity control valve assembly; therefore, for the purpose of simplicity of description, only the capacity control valve assembly will be shown in FIG. 17 to describe the structure and details of control.

As shown in FIG. 17, communicating passage 322 is provided in a cylinder block 301 and in a valve plate 304 for communicating a suction chamber 330 and a crank chamber 305. A compartment 323 is provided in the middle of the communicating passage 322, a capacity control valve assembly 350 being installed in the compartment 323. The communicating passage 322 is comprised of passages 322*a* and 322*b* of the cylinder block 301, and a hole 304*b* of the valve plate 304. The compartment 323 is comprised of a low-pressure space 325 of the cylinder block 301, a high-pressure space 326 of a rear housing 303, and a hole 304*a* of the valve plate 304. An O ring groove 360 is provided around the inner peripheral surface of the hole 304*a* of the valve plate 304. An O ring 361 fitted in the O ring groove 360 secures airtightness between the low-pressure space 325 and the high-pressure space 326.

A capacity control valve assembly 350 is made up of a valve main body 327 and a cylindrical case 328 holding the valve main body 327 as shown in FIG. 17. The valve main body 327 is composed of a valve member 327*a*, a low-pressure bellows 327*b* that expands or contracts according to a change in the suction pressure Ps, and a high-pressure bellows 327*c* that expands or contracts according to a change in the discharge pressure Pd. The interior of the low-pressure bellows 327*b* is maintained at a vacuum, while the interior of the high-pressure bellows 327*c* is maintained at the suction pressure. A valve hole 328*a* is provided at a central portion of the front end surface of the cylindrical case 328, and the valve hole 328*a* is opened and closed by the valve member 327*a* which is connected to the low-pressure bellows 327*b*.

A curved round plate spring 332 known as a curved spring is disposed between the rear end (or the left side in FIG. 17) of the cylindrical case 328 and an inner wall surface 326*a* of the high-pressure space 326 of the compartment 323. The high-pressure space 326 is in communication with a high-pressure introducing chamber 340 of the rear housing 303, and the high-pressure introducing chamber 340 is in communication with a discharge chamber, not shown, via a communicating passage 341.

The front end surface of the cylindrical case 328 is pressed, via a gasket 329, against an inner wall surface 325*a* of the low-pressure space 325 in the compartment 323. This secures airtightness between the crank chamber 305 (crank chamber area C) and the suction chamber 330 (suction pressure area S), and the crank chamber pressure Pc is securely controlled by opening or closing the capacity control valve assembly 350.

In the variable capacity swash plate type compressor incorporating the capacity control valve assembly 350 configured as described above, when the suction pressure Ps exceeds a predetermined value, the low-pressure bellows 327*b* contracts, and the valve member 327*a* opens the valve hole 328*a* in the capacity control valve assembly 350 provided in the middle of the communicating passage 322. Hence, the crank chamber 305 (crank chamber area C) is communicated with the suction chamber 330 (suction pressure area S) via the communicating passage 322*a*, the valve hole 328*a* of the cylindrical case 328, the interior of the cylindrical case 328, the hole 328*b* of the cylindrical case 328, and the communicating passage 322*b*, causing a refrigerant gas in the crank chamber 305 to be introduced into the suction chamber 330. This causes the crank chamber pressure Pc to drop, and the back pressure applied to pistons drops accordingly in the compressor. As a result, the inclination of the swash plate increases, and the stroke of the pistons becomes larger as does the discharge capacity.

The foregoing predetermined value is adjusted based on the expansion or contraction of the high-pressure bellows 327*c*, which expands or contracts according to a change in the discharge pressure Pd; the detailed description of this will be omitted.

Conversely, when the suction pressure Ps drops to the predetermined value, the low-pressure bellows 327*b* expands and the valve member 327*a* closes the valve hole 328*a* in the capacity control valve assembly 350. Hence, the communication between the crank chamber 305 and the suction chamber 330 through the foregoing passage is cut off so that the refrigerant gas in the crank chamber 305 is no longer introduced into the suction chamber 330. At this time, a blowby gas which leaks through the clearance between a cylinder bore and a piston (not shown) from a compression chamber in the cylinder bore (not shown) flows into the crank chamber 305. This influx of the blowby gas increases the crank chamber pressure Pc so that the inclination of the swash plate decreases. As a result, the stroke of the pistons becomes smaller and the discharge capacity decreases.

The variable capacity swash plate type compressor incorporating the capacity control valve assembly 350 is designed as described above to carry out the capacity control.

In the foregoing variable capacity swash plate type compressor, the passage, which allows communication between the crank chamber 305 and the suction chamber 330 via the passage 322*a*, the valve hole 328*a*, the interior of the cylindrical case 328, the hole 328*b* of the cylindrical case 328, and the communicating passage 322*b*, corresponds to the communicating passage LB in the schematic control diagram of FIG. 16. The valve mechanism comprised of the valve hole 328*a* and the valve member 327*a* corresponds to the opening/closing mechanism Vb in the schematic control diagram. Likewise, the passage that leads to the crank chamber 305 from the cylinder bore through the clearance between the cylinder bore and the pistons corresponds to the communicating passage LA in the schematic control diagram, and the clearance between the cylinder bore and the pistons corresponds to the throttle Na.

The sixth embodiment is a fixed capacity swash plate type compressor in which a cock member 300, shown in FIG. 18, for maintaining the crank chamber pressure at the suction pressure is installed, in place of the capacity control valve assembly 350 in the variable capacity swash plate type compressor, in the compartment 323 for housing the capacity control valve assembly 350. For the sake of simplifying the explanation, description of the configuration of the entire compressor will be omitted. Except for the cock member 300, the fixed capacity swash plate type compressor has exactly the same configuration as the variable capacity swash plate type compressor incorporating the conventional capacity control valve assembly 350.

The cock member 300 shown in FIG. 18 is identical to the cylindrical case 328 of the capacity control valve assembly 350, and therein, the valve main body 327, which is installed in the cylindrical case 328 in the capacity control valve assembly 350, is replaced with a charging member 351 for distinguishing between low pressure and high pressure. By installing the cock member 300 in place of the capacity control valve assembly 350 in the compartment 323, the airtightness between the low pressure space 325 and the high pressure space 326 in the compartment 93 is maintained, and the communicating passage LB in the schematic control diagram of FIG. 16 is always held in communication regardless of a change in the suction pressure.

Since the sixth embodiment is configured as described above, the crank chamber 305 (crank chamber area C) is always in communication with the suction chamber 330 (suction pressure area S) and therefore set at the suction pressure Ps regardless of a change in the suction pressure. Hence, as described in the first embodiment, the swash plate starts to rotate at the minimum inclination when the compressor is started, and the inclination increases as the difference between the high pressure and the low pressure increases. The inclination is fixed at the maximum angle during steady operation.

Thus, the fixed capacity swash plate type compressor of the sixth embodiment discussed above also permits cost reduction by employing the inexpensive cock member as in the first embodiment. In addition, further reduction in cost is possible by using the components and production control system common to those of the variable capacity swash plate type compressor.

Figure 19:
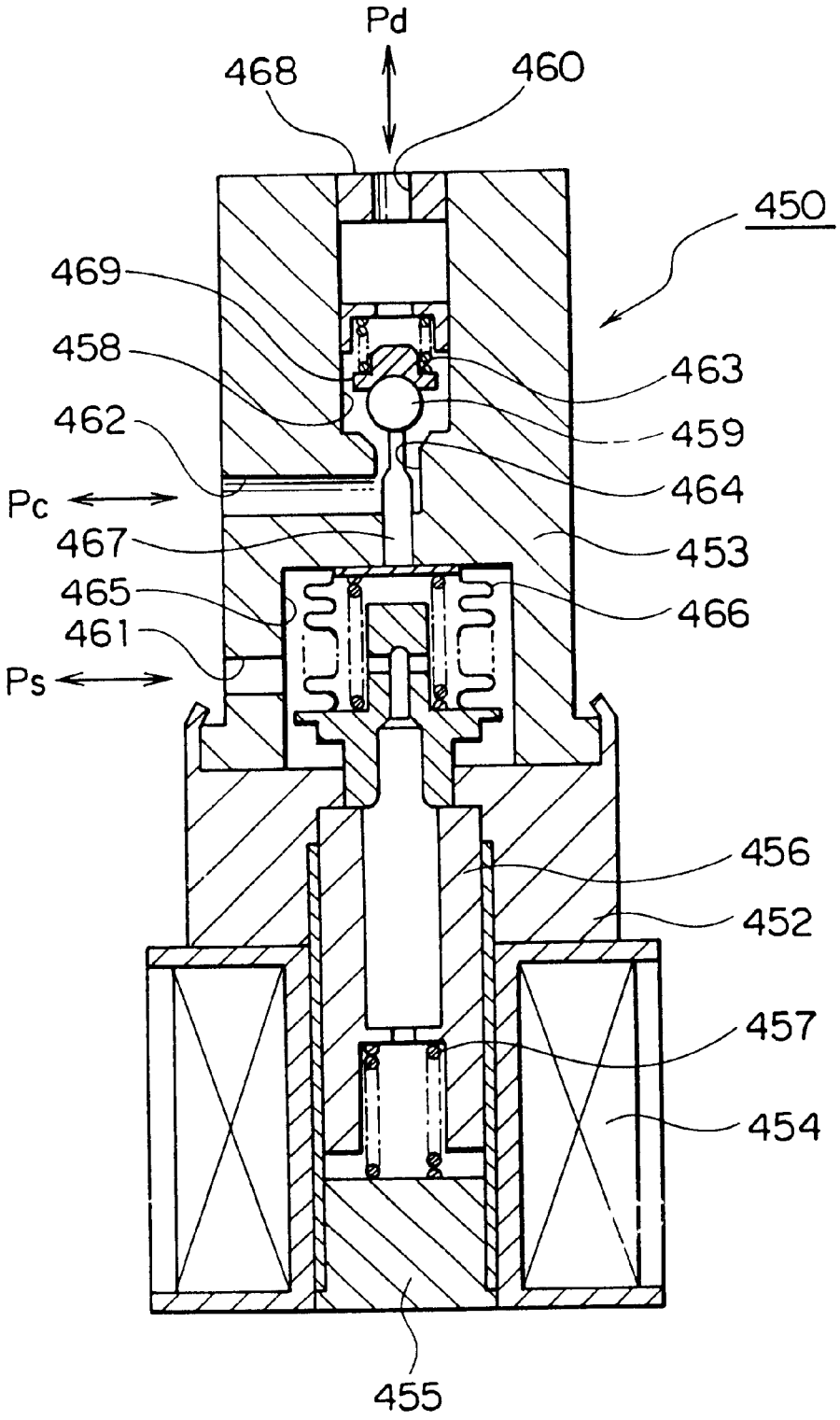
FIG. 19 PRIOR ART
FIG. 19 is a sectional view showing a capacity control valve assembly in a conventional variable capacity swash plate type compressor in accordance with a seventh embodiment.
Figure 20:
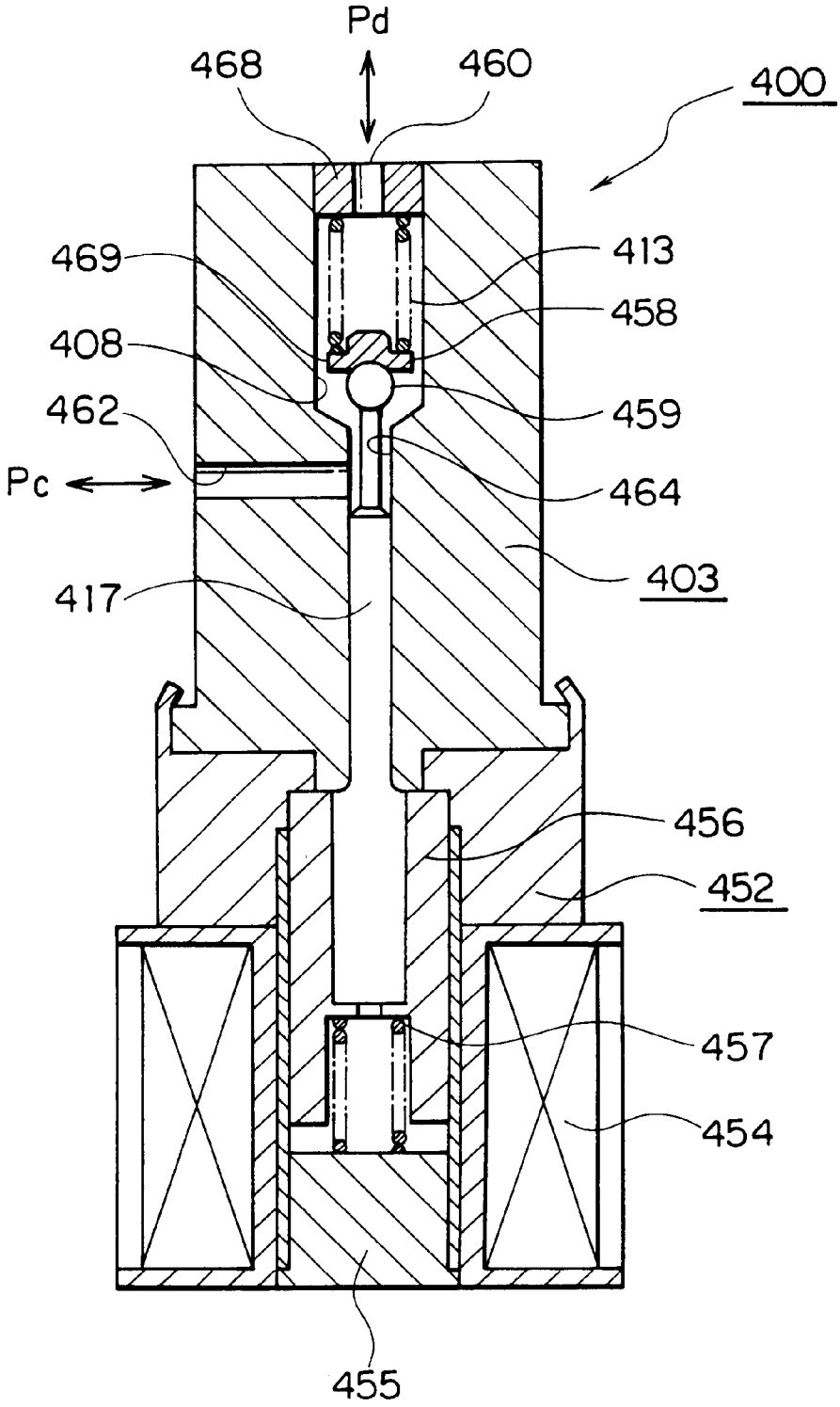
FIG. 20 is a cock member in accordance with the seventh embodiment.

Referring now to FIGS. 19 and 20, a seventh embodiment will be described. The seventh embodiment is related to the first control system shown in the schematic control diagram of FIG. 5 described in the first embodiment. A capacity control valve assembly 450 of the seventh embodiment, however, differs from the capacity control valve assembly 50 in the first embodiment in that it is an electromagnetic capacity control valve assembly.

A specific example of the above is disclosed in, for example, FIG. 6 of Japanese Patent Application Laid-open No. 9-268974. The variable capacity swash plate type compressor described in the publication is a typical compressor except for its control valve assembly, and it is considered basically the same as that described in conjunction with FIG. 1. Further, this embodiment is related only to the capacity control valve assembly. Therefore, for the purpose of simplicity of description, only the capacity control valve assembly 450 will be shown in FIG. 19 to describe the structure and details of control.

The capacity control valve assembly 450 has an electromagnetic coil assembly 452 and a valve housing 453 that are joined in the vicinity of the centers thereof. Contained inside the electromagnetic coil assembly 452 is an electromagnetic coil 454. A fixed iron core 455 is installed inside the electromagnetic coil assembly 452, and a movable iron core 456 is also installed such that it may be moved into contact with or away from the fixed iron core 455. A forced release spring 457 is installed between the two iron cores 455 and 456.

A valve member 459 is placed in a valve chamber 458 in the valve housing 453. A cover 468 that covers the opening at the distal end of the valve housing 453 is provided with a port 460 in communication with a discharge pressure area D. Provided at a central portion of the valve housing 453 are a port 461 in communication with the suction pressure area S and a port 462 in communication with a crank chamber area C. Further, a valve hole 464 is provided between the valve chamber 458 and the port 462. The valve member 459 is urged by a resetting spring 463 in a direction for closing the valve hole 464 via a retaining fixture 469. This configuration forms a passage involving the port 460, the valve chamber 458, the valve hole 464, and the port 462, the passage constituting a part of the communicating passage LA in the schematic control diagram of FIG. 5.

In a pressure sensitive chamber 465 into which the suction pressure Ps is introduced via the port 461, a bellows 466 that expands and contracts in accordance with a change in the suction pressure Ps is installed in a state wherein it is secured to the movable iron core 456. A rod 467 is attached to the distal end of the bellows 466, the distal end of the rod 467 being in contact with a valve member 459. In other words, the valve member 459 is pushed via the rod 467, and the valve hole 464 is opened and closed by the valve member 459 clamped between the rod 467 and the retaining fixture 463. Thus, the valve member 459 opens and closes the communicating passage LA between the discharge pressure area D and the crank chamber area C according to a change in the suction pressure Ps in the pressure sensitive chamber 465.

The electromagnetic coil 454 is subjected to energizing and deenergizing control carried out by an external control computer. The control computer receives information regarding, for example, the ON/OFF state of a switch of an air conditioner, engine speed, the temperature of an evaporator of an external refrigerant circuit, and a set temperature in a vehicular compartment. The control computer controls the value of current supplied to the electromagnetic coil 454 according to the foregoing information.

For instance, when the switch of the air conditioner is turned ON, the control computer gives an instruction to turn ON an electromagnetic clutch (not shown) and energizes the electromagnetic coil 454 at the same time. This causes the movable iron core 456 to be attracted to the fixed core 455 against the urging force of the forced release spring 457. The movement of the movable iron core 456 by the magnetic attraction releases the force applied by the forced release spring 457 to the valve member 459. Hence, the valve member 459 is opened or closed by the bellows 466 that expands or contracts according to a change in the suction pressure.

Thus, if a refrigeration load is high and the suction pressure Ps is high, the bellows 466 contracts to close the valve hole 464 so that a high-pressure refrigerant gas in the discharge pressure area D is no longer introduced into the crank chamber area C. Therefore, a bleed passage (the communicating passage LB), not shown, or, to be more specific a passage, corresponding to the bleed passage 35 in FIG. 1 maintains the crank chamber pressure Pc at the suction pressure Ps, and the back pressure of pistons decreases. This increases the inclination of the swash plate which increases the stroke of the pistons. As a result, the discharge capacity, i.e., the refrigerating capacity, of the compressor increases.

On the other hand, if the refrigeration load decreases and the suction pressure Ps accordingly drops, the bellows 466 expands to open the valve hole 464 so that the high-pressure refrigerant gas in the discharge pressure area D is introduced into the crank chamber area C. Therefore, the crank chamber pressure Pc increases and the back pressure of the pistons increases. This causes the inclination of the swash plate to decrease and the stroke of the pistons to becomes smaller, resulting in a reduced discharge capacity, i.e. refrigerating capacity, of the compressor. The control computer adjusts the value of the current supplied to the electromagnetic coil 454 to thereby adjust the attraction of the movable iron core 456 to the fixed iron core 455, permitting an initial set pressure of the bellows 466 to be changed.

When the switch of the air conditioner is turned OFF, the control computer gives an instruction to turn OFF the electromagnetic clutch and also deenergizes the electromagnetic coil 454 so as to release the attraction of the movable iron core 456 from the fixed iron core 455. This causes the valve member 459 to move by the urging force of the forced release spring 457 so as to forcibly open the valve hole 464.

Thus, the high-pressure refrigerant gas in the discharge pressure area D is led into the crank chamber area C so that the crank chamber pressure Pc increases. Therefore, the compressor is turned OFF with the inclination of the swash plate set at a minimum capacity position and when the compressor is started again, the swash plate will be driven at the minimum capacity position, thus suppressing the startup shock.

When the control computer determines an acceleration state based on to an engine speed, it gives an instruction to deenergize the electromagnetic coil 454. This sets the swash plate at the minimum inclination in the same manner as described above, alleviating a load on the engine at the time of acceleration.

The seventh embodiment relates to a fixed capacity swash plate type compressor in which an electromagnetic cock member 400 (shown in FIG. 20) for maintaining the crank chamber pressure at the suction pressure is installed, in place of the electromagnetic capacity control valve assembly 450 in the variable capacity swash plate type compressor, in the compartment for housing the electromagnetic capacity control valve assembly 450. Except for the electromagnetic cock member 400, the fixed capacity swash plate type compressor has exactly the same configuration, as the variable capacity swash plate type compressor incorporating the conventional electromagnetic capacity control valve assembly 450.

The electromagnetic cock member 400 shown in FIG. 20 has an electromagnetic coil assembly 452 and a valve housing 403 that are joined in the vicinity of the centers thereof. The electromagnetic coil assembly 452 has the same configuration as the foregoing electromagnetic capacity control valve assembly 450, and houses an electromagnetic coil 454 therein. A fixed iron core 455 is installed inside the electromagnetic coil assembly 452, and a movable iron core 456 is also installed such that it may be moved into contact with or away from the fixed iron core 455. A forced release spring 457 is installed between the two iron cores 455 and 456.

A valve member 459 is placed in a valve chamber 408 in the valve housing 403. A cover 468 that covers the opening at the distal end of the valve chamber 408 is provided with a port 460 in communication with a discharge pressure area D. A port 462 in communication with a crank chamber area C is provided at a central portion of the valve housing 403, that is, at the same position of the port 462 in the electromagnetic capacity control valve assembly 450. The valve member 459 is urged by a resetting spring 413 in a direction for closing a valve hole 464 via a retaining fixture 458. This configuration forms a passage involving the port 460, the valve chamber 408, the valve hole 464, and the port 462, and the passage provides communication between the discharge pressure area D and the crank chamber area C.

The electromagnetic cock member 400 does not have the pressure sensitive chamber 465 that is provided in the electromagnetic capacity control valve assembly 450. A rod 417 has one end thereof secured to the movable iron core 456, and the other end thereof in contact with the valve member 459. Hence, this electromagnetic cock member 400 has a simpler structure than the electromagnetic capacity control valve assembly 450, so that it can be fabricated at a lower manufacturing cost.

In this electromagnetic capacity control valve assembly 450, when the electromagnetic coil 454 is excited to cause the rod 417 to be attracted together with the movable iron core 456 to the fixed iron core 455, the valve member 459 closes the valve hole 464 by a pushing force of the resetting spring 413. When the electromagnetic coil 454 is deenergized, and the movable iron core 456 is not attracted to the fixed iron core 455, the valve member 459 opens the valve hole 464 via the rod 417 by the pushing force of a forced release spring 457.

Thus, the electromagnetic cock member 400 is adapted to be able to open or close the communication between the discharge pressure area D and the crank chamber area C, regardless of a change in the suction pressure, by energizing or deenergizing the electromagnetic coil 454.

The electromagnetic coil 454 is subjected to energizing and deenergizing control carried out by an external control computer as in the capacity control valve assembly 450.

For instance, when the switch of the air conditioner is turned ON, the control computer gives an instruction to turn ON an electromagnetic clutch, and energizes the electromagnetic coil 454 at the same time. This causes the movable iron core 456 to be attracted to the fixed iron core 455 against the urging force of the forced release spring 457. The movement of the movable iron core 456 by the magnetic attraction releases the opening force of the valve member 459 applied by the forced release spring 457. Hence, the valve member 459 is moved by the pushing force of the resetting spring 413 to close the valve hole 464. Hence, the passage involving the port 460, the valve chamber 408, the valve hole 464, and the port 462 stays closed at all times regardless of a change in the suction pressure, and a high-pressure refrigerant gas is no longer introduced from the discharge pressure area D into the crank chamber area C via the passage. On the other hand, the crank chamber area C is always in communication with the suction pressure area S, so that the crank chamber pressure Pc is nearly equal to the suction chamber pressure Ps. As a result, the back pressure of the pistons drops, and the inclination of the swash plate increases and the stroke of the pistons becomes larger, causing the discharge capacity, that is, the refrigerating capacity, of the compressor to be increased.

When the switch of the air conditioner is turned OFF, the control computer gives an instruction to turn OFF the electromagnetic clutch and also deenergizes the electromagnetic coil 454 so as to release the attraction of the movable iron core 456 from the fixed iron core 455. This causes the valve member 459 to move via the rod 417 by the urging force of the forced release spring 457 so as to forcibly open the valve hole 464. Thus, the high-pressure refrigerant gas in the discharge pressure area D is led into the crank chamber area C, so that the crank chamber pressure Pc increases. Therefore, the compressor is turned OFF with the inclination of the swash plate set at a position of the minimum angle; hence, when the compressor is started next, the swash plate will be driven at the minimum capacity position, thus suppressing the startup shock.

When the control computer determines an acceleration state according to an engine speed, it gives an instruction to deenergize the electromagnetic coil 454. This sets the swash plate at the minimum inclination angle in the same manner as described above, alleviating a load on the engine at the time of acceleration.

Thus, the use of the electromagnetic cock member 400 of this embodiment in a compressor provides an advantage in that the compressor can be used as a fixed capacity swash plate type compressor during normal operation, and when the compressor is stopped, it moves the swash plate to the minimum inclination angle position to prepare for the next startup. There is another advantage in that the load on an engine can be reduced since the discharge capacity can be reduced at the time of accelerating the engine.

Thus, the fixed capacity swash plate type compressor of this embodiment permits the use of the inexpensive electromagnetic cock member 400 as in the first embodiment, making it possible to reduce costs. In addition, further cost reduction is possible by using the components and the production process common to those of the variable capacity swash plate type compressor.

Since the present invention is configured as described above, it can provide the following advantages:

Inexpensive cock assemblies can be used in place of expensive capacity control valve assemblies, thus reducing the cost. Moreover, the components and the production process common to those of a variable capacity swash plate type compressor can be used, so that a further cost reduction can be achieved.

Furthermore, since a compressor is started with its swash plate set at a small angle of inclination, fluctuation in pressure at the time of a startup will be minimized, leading to longer service life of the internal components of the compressor.

Also, a separate relief valve is no longer necessary, contributing to a further reduction in cost.

Additionally, a separate oil return passage is no longer necessary, contribution to further reduction in cost.

A variable capacity swash plate type compressor can be used as fixed capacity swash plate type compressor in normal operation mode. As soon as the compressor is stopped, the swash plate is set at the minimum inclination position; hence, shock at the time of the next startup of the compressor can be positively suppressed.

What is claimed is:

1. A fixed capacity swash plate type compressor comprising:

a cylinder block provided with a plurality of cylinder bores extending axially therein;

a front housing which forms a crank chamber between itself and the cylinder block to close a front end of the cylinder block;

a rear housing which closes a rear end of the cylinder block and which defines a discharge chamber and a suction chamber therein;

a housing assembly composed of the cylinder block, the front housing, and the rear housing;

a drive shaft rotatably supported by the housing assembly;

a swash plate which rotates integrally with the drive shaft and which is provided such that an inclination thereof can be changed in accordance with a crank chamber pressure;

pistons which reciprocate in the cylinder bores in cooperation with the swash plate;

a refrigerant gas supplying passage which allows communication between a crank chamber area and a discharge pressure area;

a bleed passage which allows communication between a crank chamber area and a suction pressure area;

a compartment which is formed in the housing assembly to be able to accommodate a capacity control valve assembly that controls the opening of at least one of the communication between the crank chamber area and the discharge pressure area and the communication between the crank chamber area and the suction pressure area so as to adjust a crank chamber pressure; and a cock member which is disposed in the compartment to replace the capacity control valve assembly and which maintains continuous communication between the crank chamber area and the suction pressure area to disable capacity control while the compressor is in operation.

2. A fixed capacity swash plate type compressor according to claim 1, wherein:

the compartment is in communication with the crank chamber area and the suction pressure area and is adapted so as to be able to accommodate a capacity control valve assembly which controls opening and closing of the communication between the crank chamber area and the suction pressure area; and the cock member is arranged in the bleeding passage and is adapted to maintain the continuous communication between the crank chamber area and the suction pressure area in the compartment.

3. A fixed capacity swash plate type compressor according to claim 1, wherein:

the compartment is in communication with the discharge pressure area and the crank chamber area and is adapted so as to be able to accommodate a capacity control valve assembly which controls opening and closing of the communication between the discharge pressure area and the crank chamber area; and the cock member is adapted to always cut off the communication between the discharge pressure area and the crank chamber area in the compartment.

4. A fixed capacity swash plate type compressor according to claim 3, wherein the cock member has a passage allowing communication between the discharge pressure area and an atmospheric pressure area, and is provided with a relief valve mechanism in the passage, the relief valve mechanism releasing refrigerant gas in the discharge pressure area to the atmosphere if a discharge pressure exceeds a predetermined value.

5. A fixed capacity swash plate type compressor according to claim 1, wherein:

the compartment is in communication with the discharge pressure area, the crank chamber area, and the suction pressure area, and is adapted so as to be able to accommodate a capacity control valve assembly that controls opening and closing of the communication between the discharge pressure area and the crank chamber area, and the communication between the crank chamber area and the suction pressure area, respectively; and the cock member is arranged in the bleed passage and is adapted to always cut off the communication between the discharge pressure area and the crank chamber area in the compartment while maintaining the continuous communication between the crank chamber area and the suction pressure area.

6. A fixed capacity swash plate type compressor according to claim 1, wherein: the housing assembly has an oil reservoir for storing a lubricant separated from a discharged gas; the compartment is in communication with the oil reservoir; and the cock member has an oil return passage that allows communication between the oil reservoir and the crank chamber.

7. A fixed capacity swash plate type compressor according to claim 1, wherein: the capacity control valve assembly is an electromagnetic capacity control valve assembly provided with an electromagnetic coil that can be externally controlled; the compartment is adapted so as to be able to accommodate the electromagnetic capacity control valve assembly; the compartment is arranged in the refrigerant gas supplying passage and includes therein an electromagnetic cock member provided with an electromagnetic coil in place of the electromagnetic capacity control valve assembly; and the refrigerant gas supplying passage is closed as the electromagnetic coil is energized when the compressor is operated, while the refrigerant gas supplying passage is opened as the electromagnetic coil is deenergized when the compressor is stopped.

8. A manufacturing method for a fixed capacity swash plate type compressor, wherein the swash plate type compressor comprises:

a cylinder block provided with a plurality of cylinder bores extending axially therein;

a front housing which forms a crank chamber between itself and the cylinder block to close a front end of the cylinder block;

a rear housing which closes a rear end of the cylinder block and which defines a discharge chamber and a suction chamber therein;

a housing assembly composed of the cylinder block, the front housing, and the rear housing;

a drive shaft rotatably supported by the housing assembly;

a swash plate which rotates integrally with the drive shaft and which is provided such that an inclination thereof can be changed in accordance with a pressure in the crank chamber;

pistons which reciprocate in the cylinder bores in cooperation with the swash plate;

a refrigerant gas supplying passage which allows communication between a crank chamber area and a discharge pressure area;

a bleed passage which allows communication between the crank chamber area and a suction pressure area; and the manufacturing method comprising the steps of:

forming a compartment in the housing assembly so as to be able to selectively accommodate either a capacity control valve assembly that controls the opening of at least one of the communication between the crank chamber area and the discharge pressure area and the communication between the crank chamber area and the suction pressure area so as to adjust a crank chamber pressure or a cock member which can maintain continuous communication between the crank chamber area and the suction pressure area to disable capacity control while the compressor is in operation; and installing the cock assembly in the compartment in place of a capacity control valve assembly.

* * * * *

UNITED STATES PATENT AND TRADEMARK OFFICE

CERTIFICATE OF CORRECTION

PATENT NO. : 6,280,152 B1
DATED : August 28, 2001
INVENTOR(S) : M. Sugiura et al.

It is certified that error appears in the above-identified patent and that said Letters Patent is hereby corrected as shown below:

Column 9,
Lines 52-53, please change " a portion LA, of the communicating" to
-- a portion $LA_1$ of the communicating --;

Column 10,
Line 32, please change "main body 10a functions" to -- main body 100a functions --;

Column 16,
Line 18, please change "suction pressure, on the" to -- suction pressure. On the --.

Signed and Sealed this

Twentieth Day of August, 2002

*Attest:*

*Attesting Officer*

JAMES E. ROGAN
*Director of the United States Patent and Trademark Office*